US010054894B2

(12) United States Patent
Mine et al.

(10) Patent No.: US 10,054,894 B2
(45) Date of Patent: Aug. 21, 2018

(54) IMAGE FORMING APPARATUS

(71) Applicant: Konica Minolta, Inc., Tokyo (JP)

(72) Inventors: Hidenori Mine, Tachikawa (JP); Kenji Izumiya, Hachioji (JP); Satoshi Ogata, Hachioji (JP); Kenji Tamaki, Tokorozawa (JP); Hirokatsu Kodama, Kodaira (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/718,932

(22) Filed: Sep. 28, 2017

(65) Prior Publication Data

US 2018/0113410 A1 Apr. 26, 2018

(30) Foreign Application Priority Data

Oct. 25, 2016 (JP) ..... 2016-208752

(51) Int. Cl.

| | |
|---|---|
| ***B65H 9/00*** | (2006.01) |
| ***B65H 9/14*** | (2006.01) |
| ***B65H 5/06*** | (2006.01) |
| ***G03G 15/00*** | (2006.01) |
| ***B65H 7/20*** | (2006.01) |
| ***B65H 9/16*** | (2006.01) |

(52) U.S. Cl.

CPC ..... *G03G 15/6561* (2013.01); *B65H 5/062* (2013.01); *B65H 7/20* (2013.01); *B65H 9/004* (2013.01); *B65H 9/006* (2013.01); *B65H 9/166* (2013.01); *G03G 15/6529* (2013.01); *B65H 2403/92* (2013.01); *B65H 2515/704* (2013.01)

(58) Field of Classification Search

CPC ..... B65H 9/004; B65H 9/006; B65H 9/14; B65H 5/062; B65H 2515/71; B65H 2515/704; B65H 2511/13; G03G 15/6564; G03G 15/6561; G03G 15/6567

See application file for complete search history.

(56) References Cited

U.S. PATENT DOCUMENTS

| | | | | |
|---|---|---|---|---|
| 6,311,039 | B1 * | 10/2001 | Funamizu | B65H 5/34 399/16 |
| 2013/0187332 | A1 * | 7/2013 | Mine | B65H 5/06 271/264 |
| 2017/0291783 | A1 * | 10/2017 | Kumagai | B65H 9/006 |
| 2017/0299997 | A1 * | 10/2017 | Hamaya | B65H 7/20 |

FOREIGN PATENT DOCUMENTS

| | | | |
|---|---|---|---|
| JP | 2002308475 A | * | 10/2002 |
| JP | 2003261244 A | * | 9/2003 |
| JP | 2011145589 A | * | 7/2011 |
| JP | 2014077826 A | | 5/2014 |

* cited by examiner

*Primary Examiner* — Luis A Gonzalez
(74) *Attorney, Agent, or Firm* — Lucas & Mercanti, LLP

(57) ABSTRACT

An image forming apparatus that controls to cut off exciting currents supplied to a plurality of motors to drive conveyance roller pairs after a leading end of a paper sheet is brought in contact with a registration roller pair, and, when cutting off the exciting currents, cut off the exciting current for at least one of the motors at a different timing from the other motors.

8 Claims, 15 Drawing Sheets

IMAGE FORMING APPARATUS

CROSS-REFERENCE TO RELATED APPLICATION

This application is based on Japanese Patent Application No. 2016-208752 filed on Oct. 25, 2016, including description, claims, drawings, and abstract, the entire disclosure is the contents of which are incorporated herein by reference in its entirety.

BACKGROUND

1. Technical Field

The present invention relates to an image forming apparatus.

2. Description of Related Arts

An image forming apparatus has a plurality of roller pairs for conveying paper sheets. For example, Japanese Unexamined Patent Publication No. 2014-77826 discloses an image forming apparatus in which after a paper sheet has been conveyed from conveyance roller pairs to a pre-registration roller pair (loop roller pair), the leading end of the paper sheet is brought in contact with a registration roller pair having stopped rotation, and a loop is formed on the paper sheet. According to this image forming apparatus, in the state of having formed the loop, the rotation of the registration roller pair is started, whereby the paper sheet can be conveyed into a secondary transfer nip while performing skew correction.

SUMMARY

In a sheet conveyance mode involving a loop forming operation, after a loop has been formed on a paper sheet, the conveyance of the paper sheet has been stopped, and thereafter, the conveyance of the paper sheet is restarted. Under the situation where the paper sheet is stopped, the paper sheet is crooked within a conveyance pathway. Accordingly, the restoring force with which the paper sheet tries to return to the original flat state, acts on roller pairs. Although the restoring force becomes different depending on the thickness and kind of a paper sheet, in the case of a thick paper sheet or a paper sheet with high stiffness, the restoring force becomes high. In such a case, high load is imposed on a motor that is driving the roller pair. On the other hand, when the conveyance of a paper sheet having stopped in the state of existing over a plurality of conveyance roller pairs, is restarted, it is necessary to synchronously rotate the plurality of conveyance roller pairs. However, in the case of restarting the conveyance of the paper sheet on the high load condition, high load is being imposed on motors to drive the plurality of conveyance roller pairs. Accordingly, all the motors may not be started synchronously. As a result, out of synchronization occurs among the plurality of motors, and then, the conveyance of the paper sheet cannot be performed appropriately.

The present invention has been achieved in view of the above circumstances, and an object of the present invention is to provide an image forming apparatus that can convey a paper sheet appropriately when restarting the conveyance of the paper sheet after loop formation.

To achieve at least one of the above-mentioned objects, an image forming apparatus reflecting one aspect of the present invention comprises:

- a registration roller pair;
- a loop roller pair that is disposed on an upstream side of the registration roller pair and further pushes a paper sheet brought in contact with the registration roller pair having stopped so as to form a loop on the paper sheet;
- a plurality of conveyance roller pairs that are disposed on an upstream side of the loop roller pair;
- a plurality of motors that are provided for the plurality of conveyance roller pairs so as to rotate the plurality of conveyance roller pairs; and
- a processor that controls exciting currents to be supplied to the plurality of motors,
- wherein after a leading end of the paper sheet is brought in contact with the registration roller pair, the processor controls to cut off the exciting currents supplied to the plurality of motors, and when cutting off the exciting currents, among the plurality of motors being driving the plurality of conveyance roller pairs being conveying the paper sheet, the processor cuts off the exciting current for at least one of the motors at a different timing from the other motors.

The objects, features, and characteristics of this invention other than those set forth above will become apparent from the description given herein below with reference to preferred embodiments illustrated in the accompanying drawings.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
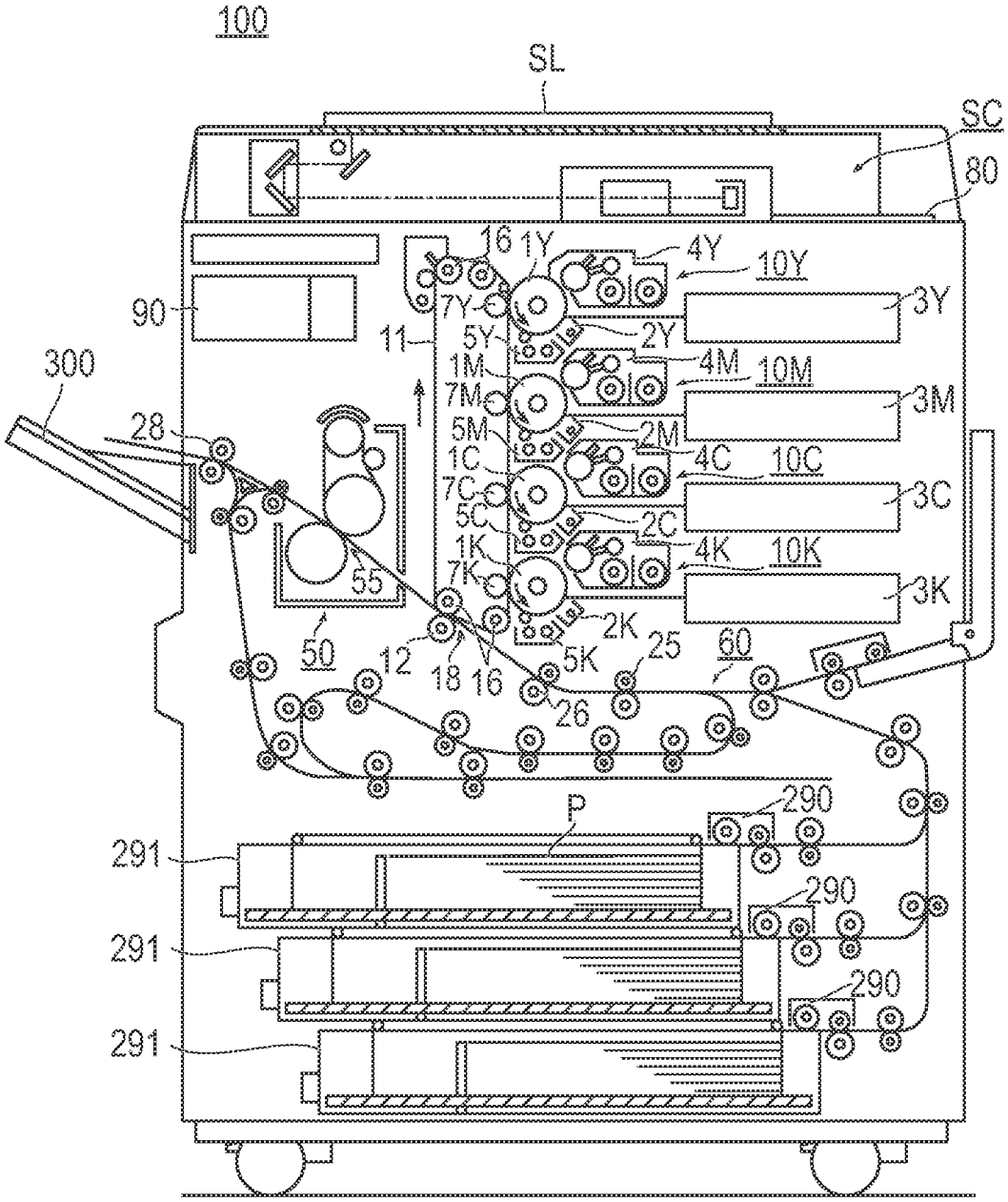
FIG. 1 is an explanatory illustration showing an example of a constitution of an image forming apparatus according to an embodiment.

Hereinafter, one or more embodiments of the present invention will be described with reference to the drawings. However, the scope of the invention is not limited to the disclosed embodiments. In the description for the drawings, the same element is provided with the same reference sign, and the duplicate description will be omitted. Furthermore, the dimensional ratios in the drawings are exaggerated on account of description, and may be different from actual ratios.

Embodiment 1

FIG. 1 is an explanatory illustration showing an example of a constitution of an image forming apparatus according to an embodiment. In FIG. 1, the inside of the image forming apparatus is looked from the front of the apparatus.

This image forming apparatus is, for example, an image forming apparatus of an electrophotographying system. The image forming apparatus of an electrophotographying system includes a primary transferor to primarily transfer a toner image electrostatically formed on an image carrier (photoconductor drum) to an intermediate transfer belt that circularly moves, a secondary transferor to transfer an intermediate toner image formed on the intermediate transfer belt to an image support, and conveyance pathways to convey a paper sheet to these respective sections.

This image forming apparatus 100 forms a color image on a recording medium (for example, paper sheet) using an image forming process of an electrophotographying system. The image forming apparatus 100 is also called a tandem type color image forming apparatus, and forms a color image with four image formers. The four image formers include an image former 10Y to form an image of yellow (Y), an image former 10M to form an image of magenta (M), an image former 10C to form an image of cyan (C), and an image former 10K to form an image of black (K).

The image former 10Y includes a photoconductor drum 1Y as an image carrier and devices disposed on the periphery of the photoconductor drum 1Y that include an electric charger 2Y, an optical writer 3Y, a developer 4Y, and a photoconductor drum cleaner 5Y. Similarly, the image former 10M includes a photoconductor drum 1M as image carrier and devices disposed on the periphery of the photoconductor drum 1M that include an electric charger 2M, an optical writer 3M, a developer 4M, and a photoconductor drum cleaner 5M. The image former 10C includes a photoconductor drum 1C as image carrier and devices disposed on the periphery of the photoconductor drum 1C that include an electric charger 2C, an optical writer 3C, a developer 4C, and a photoconductor drum cleaner 5C. The image former 10K includes a photoconductor drum 1K as image carrier and devices disposed on the periphery of the photoconductor drum 1K that include an electric charger 2K, an optical writer 3K, a developer 4K, and a photoconductor drum cleaner 5K. Each of the photoconductor drums 1Y, 1M, 1C, and 1K of the image formers 10Y, 10M, 10C, and 10K is constituted to have the same function. Similarly, each of the electric chargers 2Y, 2M, 2C, and 2K is constituted to have the same function, each of the optical writers 3Y and 3M, 3C, and 3K is constituted to have the same function, and each of the photoconductor drum cleaning devices 5Y, 5M, 5C, and 5K is constituted to have the same function.

The intermediate transfer belt 11 is wound around a plurality of support rollers 16 so as to be moveable.

The respective color toner images formed on the image formers 10Y, 10M, 10C, and 10K are transferred by the primary transferors 7Y, 7M, 7C, and 7K one by one onto the moving intermediate transfer belt 11. With this, onto the intermediate transfer belt 11, a color image (toner image) in which the respective color layers (Y, M, C, K) are superimposed, is primarily transferred.

A secondary transfer roller 12 is disposed so as to come in contact with the intermediate transfer belt 11. The secondary transfer roller 12 is driven in accordance with the movement of the intermediate transfer belt 11. On a position which faces the secondary transfer roller 12 via the intermediate transfer belt 11, one of the plurality of support rollers 16 is disposed. The secondary transfer roller 12 and the intermediate transfer belt 11 forms a secondary transfer nip portion 18 therebetween.

A conveyor 60 conveys a paper sheet P stored in a plurality of sheet trays 291. A sheet feeder 290 takes out a paper sheet P stored in the sheet tray 291, and send out the paper sheet P to the conveyor 60. The paper sheet P is conveyed to the secondary transfer nip portion 18 through the conveyor 60 via a loop roller pair 25 and a registration roller pair 26.

The color image formed on the intermediate transfer belt 11 is secondarily transferred onto the paper sheet P in the secondary transfer nip portion 18.

The paper sheet P on which the color image has been transferred, is applied with heat and pressure in a fixing nip portion 55 of a fixer 50, whereby the toner image on the paper sheet P is fused and fixed.

Figure 2:
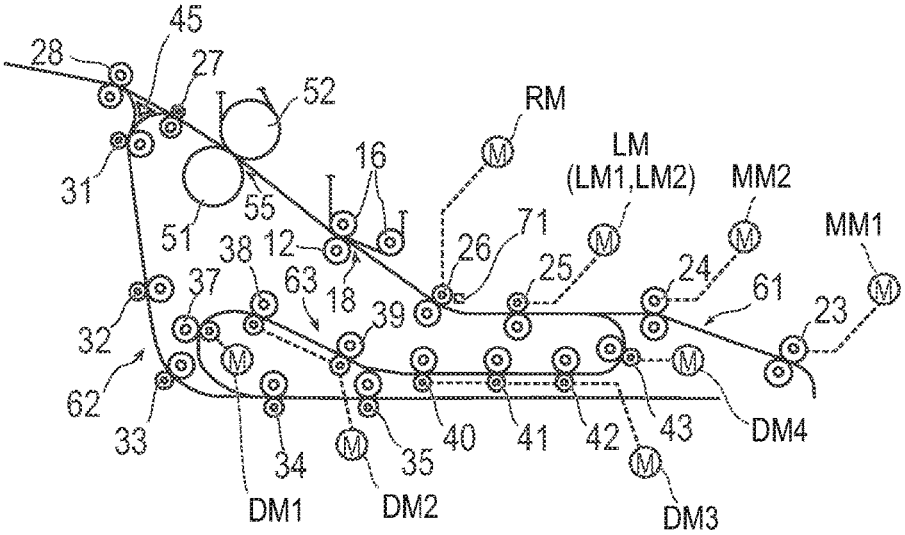
FIG. 2 is an explanatory illustration for describing a conveyance pathway of a paper sheet.

The fixer 50 includes a pair of fixing rollers 51 and 52 (refer to FIG. 2). The pair of fixing rollers 51 and 52 are arranged so as to come in contact with each other, thereby pressing the paper sheet P therebetween. The fixer 50 includes a heater (not illustrated) to heat the fixing roller 52. As the heater, for example, a halogen lamp may be used. The fixer 50 performs heat fixing by pressure and heat with the pair of fixing rollers 51 and 52 while conveying the paper sheet P, thereby fixing the image onto the paper sheet P.

The paper sheet P having been applied with fixing treatment is delivered to a sheet delivery tray 300 through a fixed-sheet delivery roller pair 27 and a delivered-sheet conveyance roller pair 28 that are disposed on the downstream side of the fixing nip portion 55.

Each of the above devices of the image forming apparatus 100 is connected with the processor 90, and is appropriately controlled by the processor 90. A CPU (not illustrated) constituted as a part of the processor 90 executes a process of counting and integrating the number of pixels of formed images, a process of counting and integrating the number of paper sheets P that have been subjected to image formation processing, and the like. The details of these processes will be described later. Programs corresponding to these processes are stored in memories (not illustrated) included in the processor 90. The function of each of the devices of the image forming apparatus 100 is exerted by executing programs corresponding to the function by the CPU.

The image forming apparatus 100 may include devices other than the above-described constitutional devices, or may not include a part of the above-described constitutional devices.

Next, description is given to an electrophotography process to perform image formation onto paper sheets with the image forming apparatus 100.

Since the electrophotography process with the image forming apparatus 100 is the same as the well-known process, its outline is described here.

The image formation as a copy machine is as follows. First, an original document is placed on a document stand which is equipped with a slit SL on its top. An image on the placed original document is subjected to scanning exposure with an optical system of a scanning exposure device of an image reading apparatus SC. The reflected light from the original document is read by a line image sensor via mirrors, and photo-electrically converted. Image information signals of each color produced by being photo-electrically converted are subjected to analog processing, A/D conversion, shading correction, image compression processing, etc. by an image processor (not illustrated). Thereafter, the resulting image information signals of each color are input into one, corresponding to the color, of the optical writers 3Y, 3M, 3C, and 3K of the image formers 10Y, 10M, 10C, and 10K.

The optical writers 3Y, 3M, 3C, and 3K of the image formers 10Y, 10M, 10C, and 10K write the image information signals onto the photoconductor drums 1Y, 1M, 1C, and 1K, and form the respective latent images based on the image information signals on the photoconductor drums 1Y, 1M, and 1C and 1K. In concrete terms, each of the photoconductor drums 1Y, 1M, 1C, and 1K includes a photoconductive layer including resins, such as polycarbonate and an organic photo conductor (Organic Photo Conductor), on a metal base substance. The surface of each of the photoconductor drums 1Y, 1M, 1C, and 1K is electrically charged with ions generated by the electric chargers 2Y, 2M, 2C, and 2K each of which includes corona discharging electrodes of such as a scorotron type. The optical writers 3Y and 3M, 3C, and 3K perform scanning exposure for the surfaces of the photoconductor drums 1Y, 1M, and 1C and 1K respectively based on the image information signals. On each of the exposed portions on the electrically charged surfaces of the photoconductor drums 1Y, 1M, 1C, and 1K, an electric potential lowers. Accordingly, the electrostatic latent images corresponding to the image information signals are formed on the surfaces of the photoconductor drums 1Y, 1M, and 1C and 1K. The developers 4Y, 4M, 4C, and 4K develop the electrostatic latent images formed on the surfaces of the photoconductor drums 1Y, 1M, and 1C and 1K with toner by utilizing electrostatic force, whereby toner images corresponding to respective colors are formed.

The toner for developing is electrically charged with the same polarity as that of the photoconductor drums 1Y, 1M, 1C, and 1K. For example, the photoconductor drums 1Y, 1M, 1C, and 1K are electrically charged with a negative polarity. Among regions on the photoconductor drums 1Y, 1M, 1C and 1K electrically charged with the negative polarity, the toners electrically charged with the negative polarity adhere to only the latent image portions where electric potentials are lowered by the optical writers 3Y and 3M, 3C, and 3K, whereby toner images are formed on the photoconductor drums 1Y, 1M, 1C and 1K. The toner images on the photoconductor drums 1Y, 1M, 1C and 1K are transferred onto the intermediate transfer belt 11 so as to form a color toner image on the intermediate transfer belt 11. At this time, in the case where the intermediate transfer belt 11 is made to have the positive polarity, it is possible to promote the transfer of the toner charged with the negative polarity to the intermediate transfer belt 11. On the intermediate transfer belt 11, patches that are not transferred to the paper sheet P are formed in order to correct print image densities, colors, and image formation positions. Toners for forming patches are charged with the negative polarity similarly to the toners for forming toner images. Successively, the toner image formed on the intermediate transfer belt 11 is transferred onto the paper sheet P at the secondary transfer nip portion 18. At this time, in the case where the paper sheet P is electrically charged with the negative polarity, it is possible to promote the transfer of the toner image electrically charged with the positive polarity by the intermediate transfer belt 11 to the paper sheet P.

The paper sheet P on which the toner image has been transferred by passing the secondary transfer nip portion 18, is conveyed to the fixer 50 so as to fix the image, and delivered to the sheet delivery tray 300.

Next, sheet conveyance will be described.

FIG. 2 is an explanatory illustration for describing conveyance pathways of a sheet. Similarly to FIG. 1, FIG. 2 is an illustration in which an inside of the image forming apparatus is looked from the front of the apparatus.

In the conveyor 60 to convey a paper sheet to the secondary transfer nip portion 18 and the fixer 50, the registration roller pair 26 and the loop roller pair 25 are disposed on the upstream side of the secondary transfer nip portion 18. The registration roller pair 26 is driven by a motor RM. Moreover, in the vicinity of the upstream side of the registration roller pair 26, a sheet detection sensor 71 is disposed. The sheet detection sensor 71 detect that the leading end of the conveyed paper sheet comes to a position where the leading end comes in contact with the registration roller pair 26.

In the loop roller pair 25, for example, at least two roller pairs are arranged in a direction (usually a direction orthogonal to a conveyance direction) that intersects with a sheet conveyance direction. These two roller pairs operate independently from each other. For this reason, the two roller pairs are driven by independent motors LM1 and LM2 (hereinafter, called collectively "motor LM"), respectively.

Since each of the motors RM and LM needs high rotational accuracy and control precision, it is desirable to use a stepping motor for each of the motors.

On the upstream side of the loop roller pair 25, as the sheet feed conveyance pathway 61, a first intermediate conveyance roller pair 23 and a second intermediate conveyance roller pair 24 are disposed in order to convey the paper sheet P fed out from the sheet tray 291. The first intermediate conveyance roller pair 23 and the second intermediate conveyance roller pair 24 are arranged in this order from the sheet tray 291 side. The first intermediate conveyance roller pair 23 and the second intermediate conveyance roller pair 24 are driven by independent motors MM1 and MM2, respectively.

Similarly to the motors RM and LM, for each of the motors MM1 and MM2, it is desirable to use a stepping motor.

After the paper sheet P fed from the sheet tray 291 has passed through the first intermediate conveyance roller pair 23 and the second intermediate conveyance roller pair 24, the paper sheet P is conveyed by the loop roller pair 25, and comes in contact with the registration roller pair 26 being in a state of having stopped rotation. Even after the paper sheet P has come in contact with the registration roller pair 26, the conveyance of the paper sheet P is continued by the roller pairs disposed on the upstream side than the registration roller pair 26. Therefore, the paper sheet P in which its leading end is made to stop by the registration roller pair 26, is continuously conveyed by the first intermediate conveyance roller pair 23, the second intermediate conveyance roller pair 24, and the loop roller pair 25. With this, a loop is formed on the paper sheet P between the registration roller pair 26 and the loop roller pair 25.

The loop formed by such a series of loop forming operations is guided by a guide member (not illustrated) so as be formed in a proper shape with a sufficient loop amount. In the case where the loop is formed on the paper sheet P, the rotation of each of the first intermediate conveyance roller pair 23, the second intermediate conveyance roller pair 24, and the loop roller pair 25 that are disposed on the upstream side than the registration roller pair 26, is stopped so that the conveyance of the paper sheet P is stopped. In a state where each of the roller pairs has stopped rotation, each of the motors RM, LM, MM1, and MM2 is energized and excited. With this, in each of the motors RM, LM, MM1, and MM2, a static torque is generated, and each of the roller pairs becomes a state of pressing down the paper sheet.

Next, in order to restart the conveyance of the paper sheet P (called registration restart), the registration roller pair 26, the loop roller pair 25, the first intermediate conveyance roller pair 23, and the second intermediate conveyance roller pair 24 are made to synchronously start rotation. With this, skew correction is performed for the paper sheet P which has come in contact with the registration roller pair 26 and has been stopping, and then, the paper sheet P is conveyed at an exact timing and sent out to the secondary transfer nip portion 18. After that, as has already described, the paper sheet is subjected to the fixing operation by the fixer 50, and then, delivered. The fixed-sheet delivery roller pair 27 and the delivered-sheet conveyance roller pair 28 that deriver the paper sheet after the fixing operation, also constitute the conveyor 60 to convey the paper sheet P.

In the case where image formation is performed also for the reverse surface of the paper sheet P, a switching gate 45 disposed between the fixed-sheet delivery roller pair 27 and the delivered-sheet conveyance roller pair 28 is switched. The paper sheet P in which the image formation for its obverse surface has been finished, is sent out to a reversing conveyance pathway 62 with the switching of the switching gate 45.

The conveyance pathways for duplex printing includes the reversing conveyance pathway 62 and a duplex conveyance pathway 63. On the reversing conveyance pathway 62, a de-curl roller pair 31, a first reversing conveyance roller pair 32, a second reversing conveyance roller pair 33, a reversing roller pair 34, and a support roller pair 35 are disposed. These roller pairs 31 to 35 are arranged in this order from the upstream side to the downstream side in the sheet conveyance direction. The de-curl roller pair 31, the first reversing conveyance roller pair 32, the second reversing conveyance roller pair 33, and the reversing roller pair 34 also constitute the conveyor 60 to convey the paper sheet P. When the paper sheet P conveyed by these roller pairs 31 to 34 is conveyed to a position where the trailing end of the paper sheet P arrives at the reversing roller pair 34, the paper sheet P is switched back by the reversing operation of the reversing roller pair 34. Successively, the paper sheet P is sent out to the duplex conveyance pathway 63. The support roller pair 35 supports the paper sheet P by idly rotating in synchronization with the movement of a portion of the paper sheet P having arrived at a position ahead of the reversing roller pair 34.

On the duplex conveyance pathway 63, seven duplex conveyance roller pairs 37 to 43 are disposed. Theses roller pairs are arranged in this order from the upstream side to the downstream side in the sheet conveyance direction. The seven duplex conveyance roller pairs 37 to 43 also constitute the conveyor 60 to convey the paper sheet P.

The paper sheet P conveyed by these duplex conveyance roller pairs 37 to 43 returns from a confluence point set between the loop roller pair 25 and the second intermediate conveyance roller pair 24 in a direction toward the loop roller pair 25.

The first duplex conveyance roller pair 37 is driven by the motor DM1. The second duplex conveyance roller pair 38 and the third duplex conveyance roller pair 39 are interlocked and driven by a single motor DM2. The fourth duplex conveyance roller pair 40, the fifth duplex conveyance roller pair 41, and the sixth duplex conveyance roller pair 42 are interlocked and driven by a single motor DM3. The seventh duplex conveyance roller pair 43 is driven by a motor DM4. Similarly to the other motors, as each of the motors DM1 to DM4, it is desirable to use a stepping motor. Although not illustrated, each of the de-curl roller pair 31, the first reversing conveyance roller pair 32, the second reversing conveyance roller pair 33, and the reversing roller pair 34 on the reversing conveyance pathway 62 is connected to a motor (as each of the motors, a stepping motor is used) to drive a corresponding one of the roller pairs.

The paper sheet P conveyed from the duplex conveyance pathway 63 is conveyed by the loop roller pair 25, and comes in contact with the registration roller pair 26 being in a state of having stopped rotation. Even after the paper sheet P has come in contact with the registration roller pair 26, the conveyance of the paper sheet P is continued by the loop roller pair 25 and the duplex conveyance roller pairs 37 to 43 that are disposed on the upstream side than the registration roller pair 26. Therefore, the paper sheet P in which its leading end is made to stop by the registration roller pair 26 is continuously conveyed by the loop roller pair 25 and the duplex conveyance roller pairs 37 to 43. With this, a loop is formed on the paper sheet P between the registration roller pair 26 and the loop roller pair 25.

The loop formed by such a series of loop forming operations is guided by a guide member (not illustrated) so as be formed in a proper shape with a sufficient loop amount. In the case where the loop is formed on the paper sheet P, the rotation of each of the loop roller pair 25 and the duplex conveyance roller pairs 37 to 43 that are disposed on the upstream side than the registration roller pair 26, is stopped so that the conveyance of the paper sheet P is stopped. At this time, in a state where each of the roller pairs has stopped rotation, an exciting current is made to flow to each of the motors RM, LM, and DM1 to DM4. With this, in each of the motors RM, LM, and DM1 to DM4, a static torque is generated, and each of the roller pairs becomes a state of pressing down the paper sheet.

In FIG. 2, the connection relationship between each of the roller pairs 23 to 28, 31 to 34, and 36 to 43 and each of the motors RM, LM, MM1, MM2, and DM1 to DM4 is shown with a dotted line. However, such a connection relationship may become different depending on the device constitution. For example, one roller of a roller pair is connected to the shaft of a motor via a connector, such as gears or a belt and pulley. Such a machine constitution is the same as the conventionally well-known constitution. Moreover, such a connection relationship should not be limited to an example shown in the illustration.

Next, in order to restart the conveyance of the paper sheet P, the registration roller pair 26, the loop roller pair 25, and the duplex conveyance roller pairs 37 to 43 are made to synchronously start rotation. With this, the paper sheet P which has come in contact with the registration roller pair 26 and has been stopping, is conveyed at an exact timing while being subjected skew correction, and sent out to the secondary transfer nip portion 18.

A crooked pathway configuration is adopted for the duplex conveyance pathway 63. With regard to a degree of crook, as a whole, the paper sheet P is crooked by 180 degrees from the duplex conveyance roller pairs 37 to 43 to the loop roller pair 25 (the leading end and the trailing end are located so as to face each other). On each of the pathway from the sixth duplex conveyance roller pair 42 to the seventh duplex conveyance roller pair 43 and the pathway from the seventh duplex conveyance roller pair 43 to the loop roller pair 25, the paper sheet P is conveyed so as to be crooked by about 90 degrees. This is because there is a need to respond to both a request to secure the length of the pathway necessary for the conveyance of the paper sheet P and a request to miniaturize an image forming apparatus body.

The seventh duplex conveyance roller pair 43 located on the most downstream side is disposed on the crooked pathway among the duplex conveyance pathway 63. Moreover, the fourth to sixth duplex conveyance roller pairs 40 to 42 located on the upstream side of the seventh duplex conveyance roller pair 43 and the first to third duplex conveyance roller pairs 37 to 39 located on the further upstream side are disposed at the respective positions so as to send the paper sheet P toward the crooked pathway. Even if the paper sheet P has high stiffness like a thick paper sheet, it is necessary to pass the paper sheet P through the crooked pathway. Accordingly, each of the first to seventh duplex conveyance roller pairs 37 to 43 disposed at such positions is set to have high conveyance power.

The loop forming operation will be described in detail.

The loop forming operation includes a case of performing for a paper sheet P conveyed from the sheet tray 291 and a case of performing for a paper sheet P conveyed from the duplex conveyance pathway 63. Herein, description is given to an example of the latter case.

Figure 3:
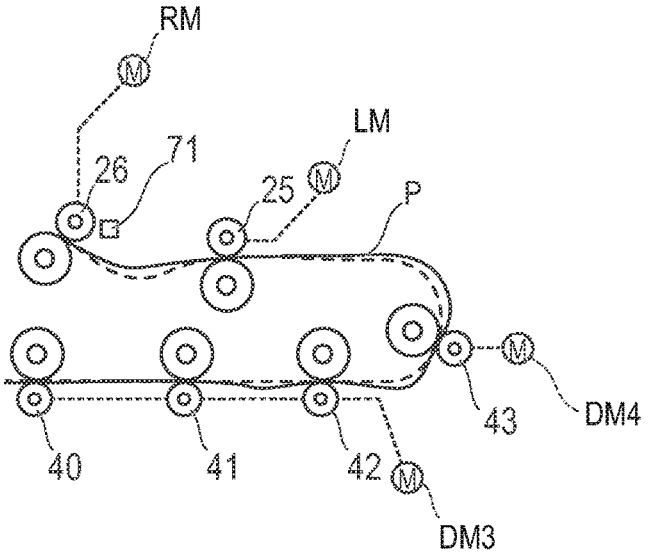
FIG. 3 is an explanatory illustration for describing a main portion of a conveyance pathway.

FIG. 3 is an illustration that is used for describing a main portion of a conveyance pathway and shows a state when each of rollers has stopped rotation at the time of forming a loop. Moreover, in FIG. 3, a continuous line shows an actual shape of the paper sheet P, and a dotted line shows an ideal shape.

At the time of forming a loop, the same paper sheet P is nipped and held by the loop roller pair 25 and the roller pairs located on the upstream side than the loop roller pair 25. FIG. 3 shows a case where the paper sheet P is an A3 size sheet, and at the time of forming a loop, the same paper sheet P is nipped and held by the loop roller pair 25 and the fourth to seventh duplex conveyance roller pairs 40 to 43. In the loop forming operation, these loop roller pair 25 and fourth to seventh duplex conveyance roller pairs 40 to 43 are rotated with the same pitch (synchronously). Of course, in a case where the paper sheet P is a sheet longer than the A3 size sheet, for example, a sheet with a length exceeding the length of the A3 size sheet in the longitudinal direction, the first to third duplex conveyance roller pairs 37 to 39 located on the further upstream side are rotated synchronously.

As have already described, in the loop forming operation, the paper sheet P sent out from the duplex conveyance pathway 63 is conveyed by the loop roller pair 25, the seventh duplex conveyance roller pair 43, the sixth duplex conveyance roller pair 42, the fifth duplex conveyance roller pair 41, and the fourth duplex conveyance roller pair 40 and comes in contact with the registration roller pair 26 being in a state of having stopped rotation. As a result, a loop is formed on the paper sheet P between the registration roller pair 26 and the loop roller pair 25. At this time, the paper sheet P is made to come in contact with the registration roller pair 26, whereby the skew of the paper sheet P is corrected. However, in the case where friction with the loop roller pair 25 is too strong, there is a possibility that the loop may be deformed along with the skew correction. For this reason, the loop roller pair 25 is constituted such that its friction to the paper sheet P may become weaker rather than that of each of the duplex conveyance roller pairs located on the upstream side of the loop roller pair 25. With this, while the loop is being formed, or after the loop has been formed, the paper sheet P slips moderately between the loop roller pair 25, whereby the loop is formed so as to perform skew correction and force more than necessary is made not to be applied to the paper sheet P.

When the formation of a loop is started, the force (referred to as "restoring force" of the paper sheet P) trying to eliminate the loop is accumulated on the paper sheet P based on the stiffness of the paper sheet P. The restoring force of the paper sheet P is a force in a direction against the force that the loop roller pair 25 attempts to deliver the paper sheet P. For this reason, there is a possibility that a slip arises between the loop roller pair 25 and the paper sheet P and the paper sheet P may not be sent out appropriately by the loop roller pair 25. On the other hand, each of the fourth to seventh duplex conveyance roller pairs 40 to 43 is a roller pair disposed on the crooked pathway and a roller pair to send out the paper sheet P to the crooked pathway. Accordingly, each of the fourth to seventh duplex conveyance roller pairs 40 to 43 is set to have high conveyance power. For this reason, at each of the fourth to seventh duplex conveyance roller pairs 40 to 43, the paper sheet P hardly slips. Therefore, as shown with the continuous line in FIG. 3, loops may be formed on the paper sheet P between the loop roller pair 25 and the seventh duplex conveyance roller pair 43 and between the seventh duplex conveyance roller pair 43 and the sixth duplex conveyance roller pair 42 on the further upstream side. Such a loop formed on a portion other than the portion between the registration roller pair 26 and the loop roller pair 25 is called a secondary loop.

On the other hand, when the loop forming operation is finished, the rotation of each of the roller pairs located on the upstream side than the registration roller pair 26 is stopped. Then, at a time point when the rotation of each of the roller pairs has been stopped, the forces (this is also the restoring force of the paper sheet P) caused by the secondary loops trying to return to the respective original states based on the stiffness of the paper sheet P act on the fourth to seventh duplex conveyance roller pairs 40 to 43. For this reason, the motors DM3 and DM4 to drive the fourth to seventh duplex conveyance roller pairs 40 to 43 become a state where high load has acted. In particular, the motor DM4 receives the restoring force of each of the secondary loop formed between the loop roller pair 25 and the seventh duplex conveyance roller pair 43 and the secondary loop formed between the seventh duplex conveyance roller pair 43 and the sixth duplex conveyance roller pair 42. Accordingly, high load acts on the motor DM4.

In such a high load state, in the case of restarting the conveyance of the paper sheet P, when the rotation of each of the motors DM3 and DM4 is started, or accelerated, the motors DM3 and DM4 may become out of synchronization. Accordingly, the paper sheet P may be unable to be conveyed appropriately. In particular, this phenomenon becomes remarkable in a case where the paper sheet P which is a thick paper sheet with high stiffness is conveyed.

The stiffness of a paper sheet is what is said to be "rigidity" of the paper sheet, and becomes high as basis weight or thickness becomes larger. For example, the stiffness of a paper sheet is proportional to 2 to 3 power of the thickness of the paper sheet. If the thickness of the paper sheet P is constant, the stiffness of the paper sheet P is directly proportional to the density (bulk density) of the paper sheet P. Therefore, as the thickness of the paper sheet P becomes thicker, or as its density becomes higher if the thickness is the same, its stiffness becomes higher. Furthermore, as the stiffness becomes higher, the possibility that the motor becomes out of synchronization at the time of restarting, becomes higher.

Then, in the present embodiment, after the loop forming operation for the paper sheet P has been finished and the paper sheet P has been stopped, that is, after each of the roller pairs has been stopped, it has been decided to release the static torque in each of the motors DM3 and DM4 to drive the fourth to seventh duplex conveyance roller pairs 40 to 43 disposed on the upstream side than the loop roller pair 25. Moreover, it has been decided that the static torque in the motor DM3 is released first, and thereafter, the static torque in the motor DM4 is released. With this, each of the fourth to seventh duplex conveyance roller pairs 40 to 43 is allowed to rotate reversely (reverse rotation) so as to absorb the restoring force of the paper sheet P. Moreover, the static torque in the motor DM3 and the static torque in the motor DM4 are separately released at different timings. Accordingly, since the restoring forces of the paper sheet P are not released simultaneously, large force is not applied to the loop roller pair 25.

Figure 4:
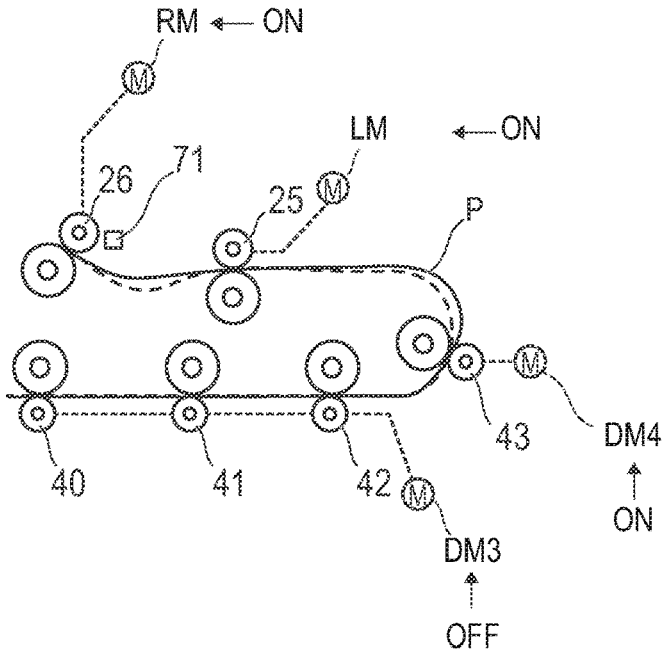
FIG. 4 is an illustration showing a state where static torques in motors to drive the fourth to sixth duplex conveyance roller pairs are released.
Figure 5:
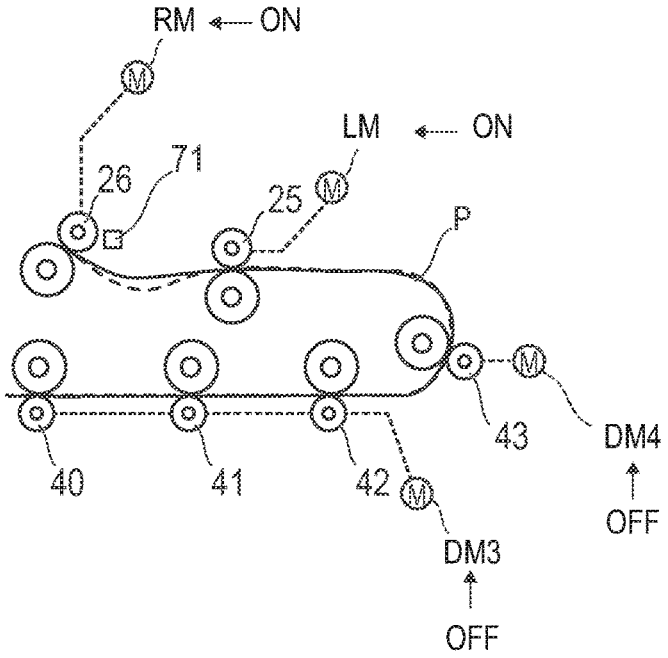
FIG. 5 is an illustration showing a state where a static torque in a motor to drive the seventh duplex conveyance roller pair is released.

Description is given in more concrete. FIG. 4 is an illustration showing a state where the static torque in the motor DM3 to drive the fourth to sixth duplex conveyance roller pairs 40 to 42 has been released from the state shown in FIG. 3. FIG. 5 is an illustration showing a state where the static torque in the motor DM4 to drive the seventh duplex conveyance roller pair 43 has been released moreover from the state shown in FIG. 4.

In order to release the static torque in a motor, it may be allowed to cut off (block) the electric power for the motor so as to cut off an exciting current for the motor.

The state shown in FIG. 3 where each of rollers has been stopped after the loop has been formed is a state where an exciting current is supplied to each of the motors DM3 and DM4 so as to stop the motors DM3 and DM4 (the other motors are in the same state). With this, in each of the motors DM3 and DM4, static torque has been generated.

From this state, as shown in FIG. 4, the exciting current for the motor DM3 is cut off. With this, the static torque is released, and the output shaft of the motor DM3 becomes so as to rotate freely. Furthermore, with this, in response to the restoring force of the paper sheet P, the fourth to sixth duplex conveyance roller pairs 40 to 42 rotate reversely, and then, the paper sheet P restores to the state required for a paper sheet along the pathway configuration on the upstream side than the seventh duplex conveyance roller pair 43. Moreover, after that, as shown in FIG. 5, the exciting current for the motor DM4 is cut off. With this, the static torque is released, and the output shaft of the motor DM4 becomes so as to rotate freely. Furthermore, with this, in response to the restoring force of the paper sheet P, the seventh duplex conveyance roller pairs 43 rotates reversely, and then, the paper sheet P restores to the state required for a paper sheet along the pathway configuration on the upstream side than the loop roller pair 25.

In this way, by cutting off the exciting currents sequentially, it becomes possible to avoid a state where high load acts on the motors DM3 and DM4. Moreover, the exciting currents for the motors DM3 and DM4 being conveying the paper sheet P are not cut off simultaneously, and are cut off sequentially from the upstream side at the respective different timings. Accordingly, the respective restoring forces caused by the secondary loops of the paper sheet P are released gradually from the upstream side.

Description is given to the reason why the timings to cuts off these exciting currents are made different for each motor. As the timing to cut off the exciting current, for example, it may be considered that the exciting currents for all the motors are cut off simultaneously. In that case, the restoring forces of the paper sheet P caused by two or more secondary loops will be released simultaneously on the portions on the upstream side rom the loop roller pair 25. Then, there is a possibility that the paper sheet P moves backward so as to explode with the force when the restoring force is released. As a result, the force at the time of releasing the restoring force cannot be suppressed only by the nipping power of the loop roller pair 25. Accordingly, there is a possibility that the normal loop formed between the registration roller pair 26 and the loop roller pair 25 may disappear, or sheet bending may be caused.

In the present embodiment, as has already described, a timing to cut off an exciting current is made different for each motor so as to prevent two or more secondary loops from being released simultaneously, whereby the disappearance of the normal loop and the occurrence of the sheet bending are prevented or suppressed.

By doing in this way, the heavy load state of each of the motors DM3 and DM4 is eliminated. Accordingly, the occurrence of out of synchronization at the time of restarting is suppressed or prevented. As a result, the conveyance of the paper sheet P can be performed appropriately.

Herein, description is given to an example where an A3 size sheet is used as the paper sheet P. For this reason, at a time point when the leading end of the paper sheet P in the conveyance direction has arrived at the registration roller pair 26, its trailing end exists up to the fourth duplex conveyance roller pair 40. Accordingly, the exciting current for each of the motors DM1 and DM2 other than the motors DM3 and DM4 may not be cut off so as to continue the exciting state as it is. On the other hand, in the case where a sheet longer than the A3 size sheet is used, its trailing end remains up to the third duplex conveyance roller pair 39 or the second duplex conveyance roller pair 38, and in the case where a sheet is more longer, its trailing end may remain up to the first duplex conveyance roller pair 37. In such a case, the exciting current for the motor DM1 is cut off first, next, the exciting current for the motor DM2 is cut off, then the exciting current for the motor DM3 is cut off, and finally, the exciting current for the motor DM4 is cut off. By doing in this way, even if a long sheet is used, the restoring forces of the paper sheet P are released sequentially from the upstream side (trailing end side).

Next, the restarting of the conveyance of the paper sheet P is described. In the restarting of the conveyance of the paper sheet P, first, an exciting current is made to flow (excitation ON) into each of the motors DM3 and DM4 so as to generate a static torque in a state of having stopped. Thereafter, after a predetermined excitation period has elapsed, the pulse signals for rotation are supplied to each of the motors DM3 and DM4 so as to rotate the motors DM3 and DM4. At the time of the restarting, the motors RM and LM to drive the registration roller pair 26 and the loop roller pair 25 respectively are also started in synchronization with the motors DM3 and DM4. With this, the conveyance to perform printing is started.

In the case where the state of cutting off the exciting current for each of the motors DM3 and DM4 is switched (from OFF to ON) to the state of making an exciting current flow into each of them, with the flowing of the exciting current, the output shaft of each of the motors DM3 and DM4 is switched from the state of free to a state of generating torque. At this time, the output shaft causes minute vibration. Moreover, at this time, gears and the like connected to the output shaft shift to a state of engaging with each other. However, in the case where the motors are made to start rotation while the respective minute vibrations are occurring, since the vibration state is different for each of the motors, there is fear that the motors become out of synchronization. Then, during a small period of time after the exciting currents are made to flow, the motors are made to stand still. Subsequently, after the vibrations have stopped, the motors are made to rotate. The time from the exciting current ON to the rotation start is referred to as "pre-excitation time". The pre-excitation time is determined beforehand to a value corresponding to the characteristics of each of the motors DM3 and DM4 through the experiment and the simulation.

Figure 6:
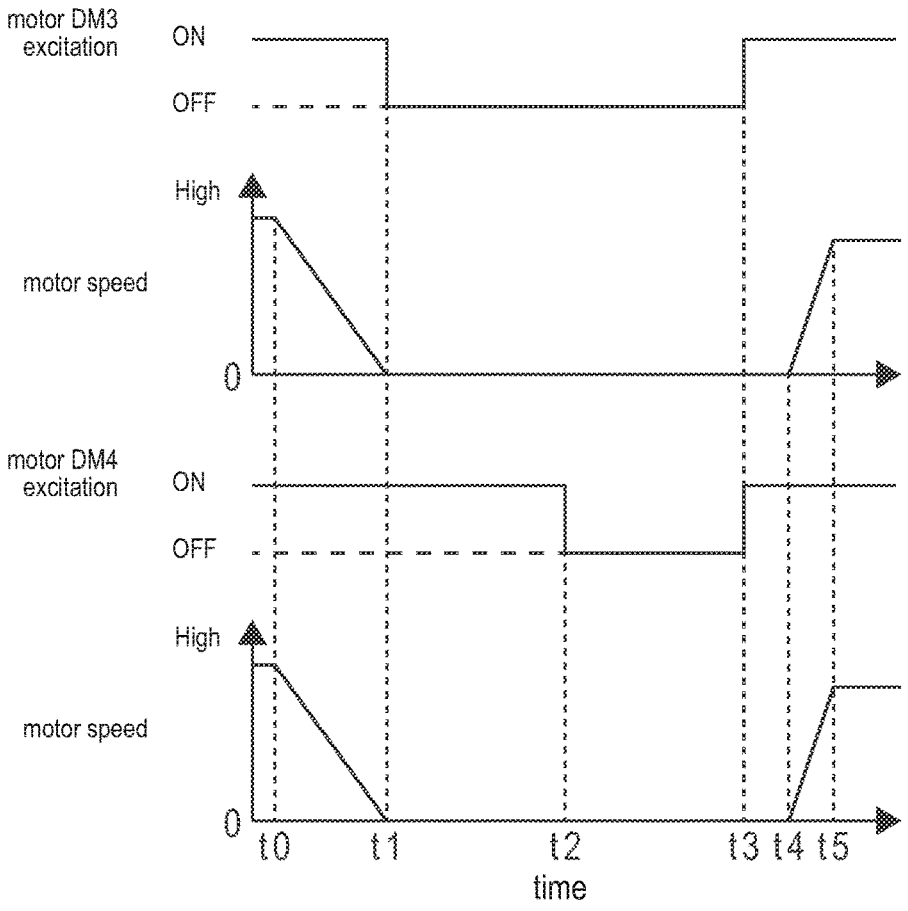
FIG. 6 is a time chart showing a timing of operation of each of motors DM3 and DM4 in Embodiment 1.

Herein, the timing of cutting off an exciting current and the timing of restarting are described based on a time chart. FIG. 6 is a time chart showing the timing of operation of each of the motors DM3 and DM4 in Embodiment 1. In FIG. 6, the time chart of the motor DM3 is arranged above the time chart of the motor DM4 so as to try to make the timings of the both motors understandable. Moreover, in each time chart, ON and OFF of an exciting current are shown at the upper stage, and the outline of the rotation speed of the motor is shown at the lower stage. Furthermore, an axis of abscissa is the time axis. On the time axis, "t number" represents the elapsed time, and as the number is larger, the larger number indicates that time has elapsed more. Also, in the other time charts described later, for example, the same numerical value of "t numeral" indicates the same time.

With reference to FIG. 6, at the stage of time t0, the leading end of the paper sheet P arrives at the registration roller pair 26, and deceleration is started. The motor DM3 and the motor DM4 are made to decelerate at the same timing at the same deceleration rate. Then, at time t1, the motor DM3 and the motor DM4 stop. While the paper sheet P is conveyed at the decelerated speed during a period from time t0 to time t1, a loop is formed between the registration roller pair 26 and the loop roller pair 25, and at time t1, the loop formation has been completed. Moreover, at the time t1, the deceleration is finished, and the motor DM3 and the motor DM4 stop. Successively, simultaneously with the stop of the motor DM3, the exciting current for the motor DM3 is cut off. With this, the static torque is released so that each of the fourth to sixth duplex conveyance roller pairs 40 to 42 can rotate freely. At this time point, the motor DM4 located nearer to the loop roller pair 25 is in the state where an exciting current is made to flow into it and the static torque is working effectively. Then, at time t2, the exciting current for the motor DM4 is cut off. With this, the static torque in the motor DM4 is released so that the seventh duplex conveyance roller pair 43 can rotate freely. After that, at time t3, an exciting current is made to flow into each of the motor DM3 and the motor DM4. At this time, the rotation of each of the motor DM3 and the motor DM4 is still stopped. Subsequently, at time t4, the rotation of each of the motor DM3 and the motor DM4 is started (also the motor RM and the motor LM are started synchronously). An interval between the time t3 and the time t4 serves as a pre-excitation time. As has already described, the pre-excitation time is the time peculiar to the motor. Accordingly, actually, the pre-excitation time of the motor DM4 may be slightly different from that of the motor DM3. However, in this embodiment, the pre-excitation time of the motor DM4 is indicated as being the same with that of the motor DM3. Thereafter, each of the motors DM3 and DM4 is accelerated, and at time t5, the speed of each of the motors DM3 and DM4 becomes the process speed for printing.

In this way, in the present Embodiment 1, the time from the time t1 to the time t4 is taken for the processes from the stopping of conveyance to the restarting.

It is desirable to perform such control for a conveyance roller pair not only for the duplex conveyance pathway 63 but also for the sheet feed conveyance pathway 61. That is, after the fed paper sheet P has been brought in contact with the registration roller pair 26 and a loop has been formed, first, the excitation current for the motor MM1 being driving the first intermediate conveyance roller pair 23, is cut off. Subsequently, the excitation current for the motor MM2 being driving the second intermediate conveyance roller pair 23, is cut off. With this, also on the sheet feed conveyance pathway 61, the restoring forces caused by the formation of a loop on the paper sheet P are released from the upstream side.

Figure 7:
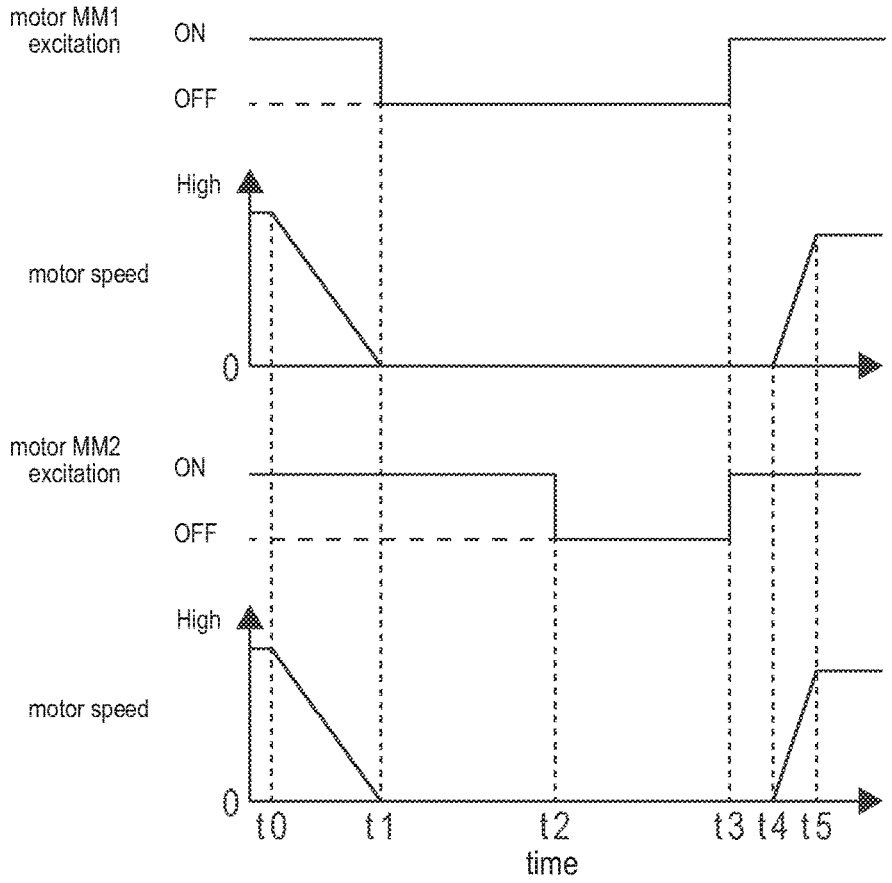
FIG. 7 is a time chart showing an operation timing of each of motors MM1 and MM2 in a first control mode.

FIG. 7 is a time chart showing the timing of operation in the first control mode for the motors MM1 and MM2.

In the first control mode, also in the sheet feed conveyance pathway 61, the control is almost the same as that in the case of the duplex conveyance pathway 63. With reference to FIG. 7, at the stage of time t0, the leading end of the paper sheet P arrives at the registration roller pair 26, and deceleration is started. The motor MM1 and the motor MM2 are made to decelerate at the same timing at the same deceleration rate. Then, at time t1, the motor MM1 and the motor MM2 stop. While the paper sheet P is conveyed at a decelerated speed during a period from the time t0 to the time t1, a loop is formed on the paper sheet P between the registration roller pair 26 and the loop roller pair 25. At the time t1, the deceleration is finished, and the motor MM1 and the motor MM2 stop. Simultaneously with the stop of the motor MM1, the exciting current for the motor MM1 is cut off. With this, the static torque in the motor MM1 is released so that the first intermediate conveyance roller pair 23 can rotate freely. At this time point, the motor MM2 located nearer to the loop roller pair 25 is in a state where an exciting current is made to flow into it and the static torque is working effectively. Then, at time t2, the exciting current for the motor MM2 is cut off. With this, the static torque in the motor MM2 is released so that the second intermediate conveyance roller pair 24 can rotate freely. Subsequently, at time t3, an exciting current is made to flow into each of the motor MM1 and the motor MM2. At this time, the rotation of each of the motor MM1 and the motor MM2 is still stopped. Subsequently, at time t4, the rotation of each of the motor MM1 and the motor MM2 is started. An interval between the time t3 and the time t4 serves as a pre-excitation time. As has already described, the pre-excitation time is the time peculiar to the motor. Accordingly, actually, the pre-excitation time of the motor MM2 may be slightly different from that of the motor MM1. However, in this embodiment, the pre-excitation time of the motor MM2 is shown as being the same with that of the motor MM1. Thereafter, each of the motors MM1 and MM2 is accelerated, and at time t5, the speed of each of the motors MM1 and MM2 becomes the process speed for printing.

In this way, in the first control mode, also in the sheet feed conveyance pathway 61, the time from the time t1 to the time t4 is taken for the processes from the stopping to the restarting the rotation of the motors.

By the way, the sheet feed conveyance pathway 61 is not made to a constitution to crook a sheet as much as the duplex conveyance pathway 63. Accordingly, since the crook of a paper sheet passing through there is small, the restoring force stored in the paper sheet is also small. For this reason, the loads imposed on the motors MM1 and MM2 are not as high as those on the motors DM3 and DM4 on the duplex conveyance pathway 63. Then, in order to reduce the time taken for the processes from the stopping of conveyance after the registration to the restarting, it is possible to change the timing of the start of excitation for the motors MM1 and MM2 before the restarting of conveyance.

Figure 8:
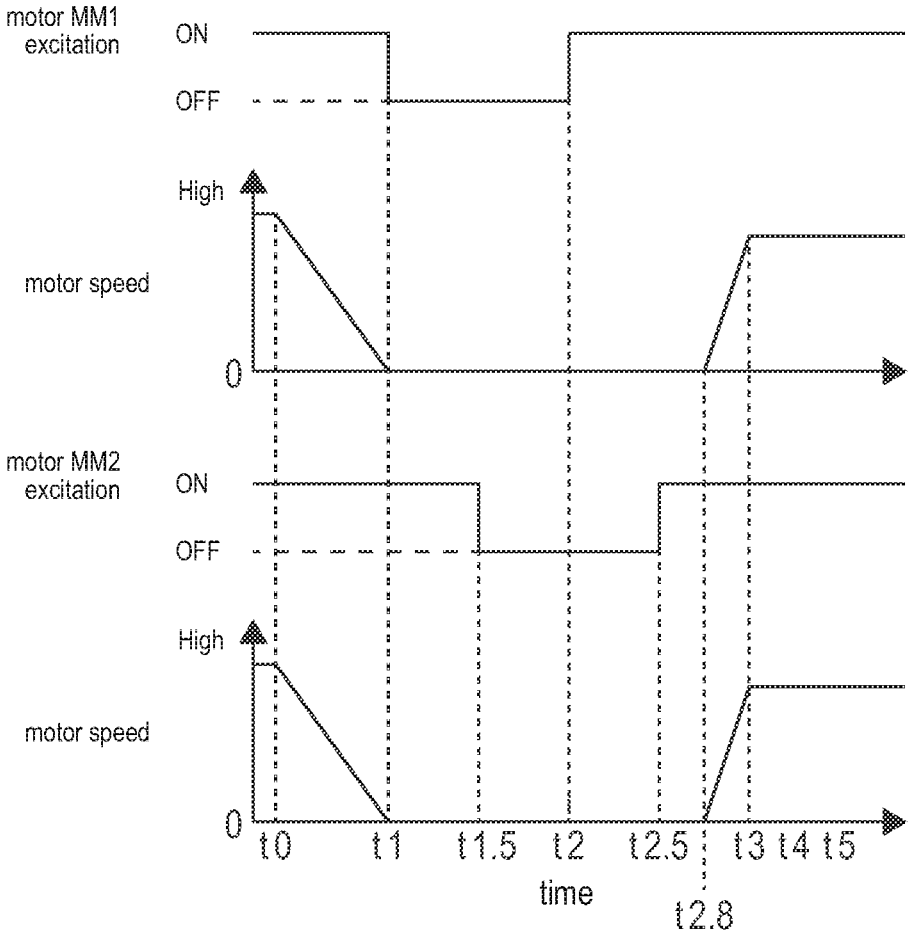
FIG. 8 is a time chart showing an operation timing of each of motors MM1 and MM2 in a second control mode.

FIG. 8 is a time chart showing the timing of operation in the second control mode for the motors MM1 and MM2.

With reference to FIG. 8, at the stage of time t0, the leading end of the paper sheet P arrives at the registration roller pair 26, and deceleration is started. The motor MM1 and the motor MM2 are made to decelerate at the same timing at the same deceleration rate. Then, at time t1, the motor MM1 and the motor MM2 stop. While the paper sheet P is conveyed at the decelerated speed during a period from the time t0 to the time t1, a loop is formed on the paper sheet P between the registration roller pair 26 and the loop roller pair 25. Subsequently, at time t1, the deceleration is finished, and the motor MM1 and the motor MM2 stop. Simultaneously with the stop of the motor MM1, the exciting current for the motor MM1 is cut off. With this, the static torque in the motor MM1 is released so that the first intermediate conveyance roller pair 23 can rotate freely. At this time point, the motor MM2 located nearer to the loop roller pair 25 is in a state where an exciting current is made to flow into it and the static torque is working effectively. Up to this point, the control mode is the same as the first control mode described with reference to FIG. 7.

Thereafter, in the second control mode, at a time point of time t1.5, the exciting current for the motor MM2 is cut off. With this, the static torque in the motor MM2 is released so that the second intermediate conveyance roller pair 24 can rotate freely. Subsequently, at a time point of time t2, an exciting current is made to flow into the motor MM1, and at a time point of time t2.5, an exciting current is made to flow into the motor MM2. At this time, the rotation of each of the motor MM1 and the motor MM2 is still stopped. Subsequently, at a time point of time t2.8, the rotation of each of the motor MM1 and the motor MM2 is started (the motors RM and LM are also started synchronously). Thereafter, each of the motors MM1 and MM2 is accelerated, and at time t3, the speed of each of the motors MM1 and MM2 becomes the process speed for printing.

In this way, in the second control mode, in the sheet feed conveyance pathway 61, the time taken for the processes from the stopping in the registration to the restarting becomes the time from the time t1 to the time t3. Accordingly, the time can be shortened than the first control mode shown in FIG. 7. This is because the rate of crook of the paper sheet P is small and the restoring force stored in the paper sheet P having stopped on the sheet feed conveyance pathway 61 is also small. Accordingly, before the restoring force on the upstream side (on the farther side from the registration roller pair 26) has run out, an excitation current for the motor MM1 may be turned ON. For this reason, the stopping time from the loop formation to the restarting of the sheet conveyance after the registration can be reduced, and the restarting can be performed quickly correspondingly to the reduced time.

Figure 9:
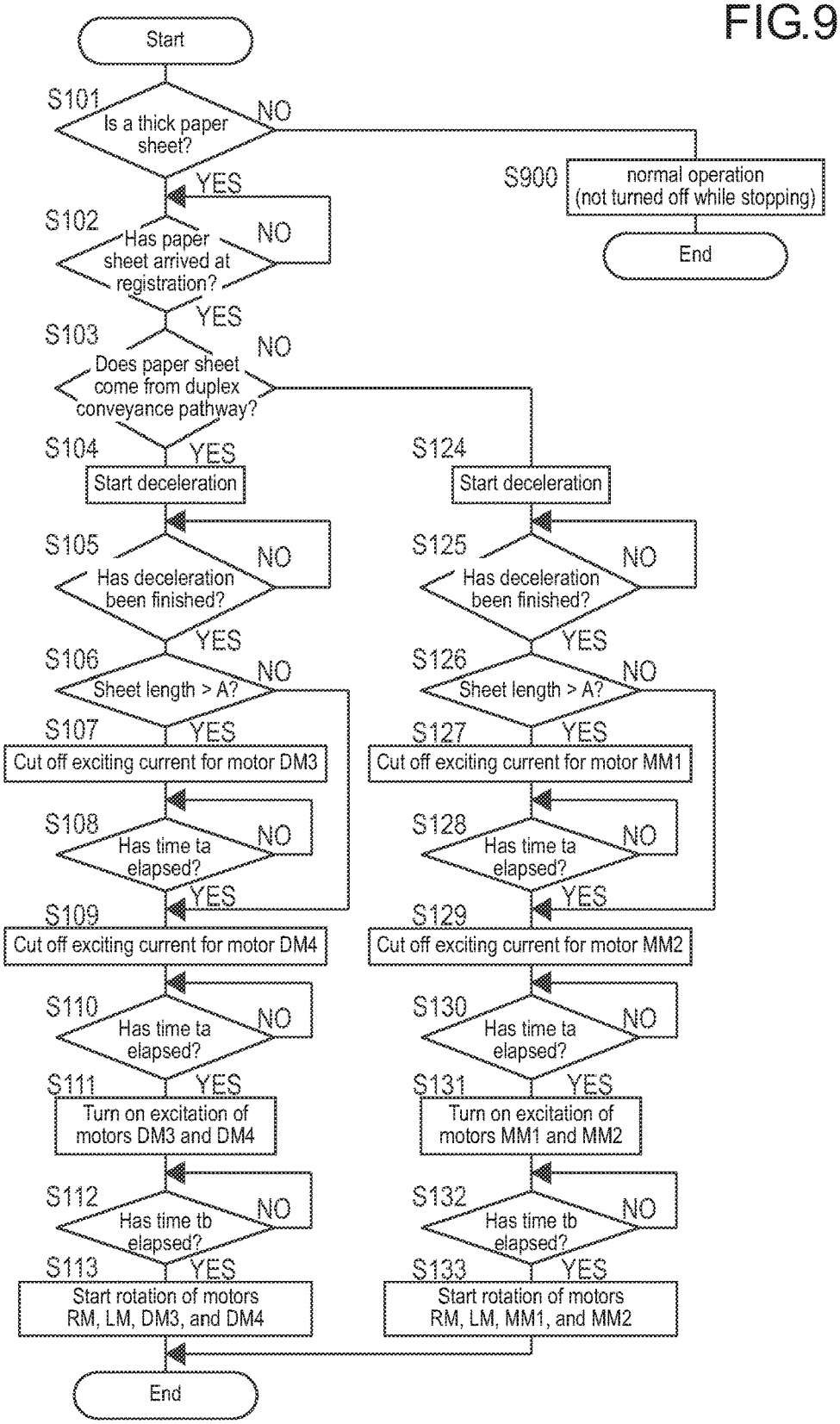
FIG. 9 is a flow chart showing control procedures for the image forming apparatus according to Embodiment 1.

Next, the control procedures according to Embodiment 1 are described. FIG. 9 is a flowchart showing the control procedures for the image forming apparatus according to Embodiment 1.

The control procedures are executed by the processor 90. First, the processor 90 determines whether a paper sheet P currently being conveyed is a thick paper sheet (S101). Whether the paper sheet P is a thick paper sheet is determined based on the basis weight. As is well known, the basis weight is a weight per 1 $m^2$. Therefore, in the case where the quality (density) of a paper sheet is the same, a paper sheet with the larger basis weight is determined as a thick paper sheet. In the case where the quality of a paper sheet is different, if the thickness is the same, a paper sheet with the high basis weight has the high density. Accordingly, it can be determined that the stiffness of the paper sheet is high. As the criterion of the determination, a paper sheet with a basis weight of 200 gsm or more is made a thick paper sheet. Although the stiffness of a paper sheet determined as a thick paper sheet in this way is slightly different depending on the paper quality, the stiffness of the paper sheet is about 400 mN·m or more. The criterion for determining whether a paper sheet is a thick paper sheet or not may be changed depending on the paper quality. Moreover, in place of the basis weight, whether a paper sheet is a thick paper sheet or not may be determined directly based on the value of thickness or stiffness.

Such basis weight (or thickness or stiffness) of a paper sheet is supplied as specification of the paper sheet P currently being used. The basis weight (or thickness or stiffness) is automatically discriminated or input by a user at the stage where paper sheets P are set in the sheet tray 291. Accordingly, whether a paper sheet is a thick paper sheet or not is determined based on those values.

If it is determined that the paper sheet P is not a thick paper sheet in S101 (S101: NO), the operation is shifted to a normal operation (S900), and this process is ended. In the normal operation, while the paper sheet P has been brought in contact with the registration and has been stopped, the exciting currents for motors for the conveyance rollers are not cut off (not turned off).

On the other hand, if it is determined that the paper sheet P is a thick paper sheet in S101 (S101: YES), successively, the processor 90 determines whether the leading end of the paper sheet P has arrived at the registration roller pair 26 (S102). When the sheet detection sensor 71 detect the leading end of the paper sheet P, it is determined that the leading end of the paper sheet P has arrived at the registration roller pair 26. Here, if the leading end of the paper sheet P has not arrived at a position before the registration roller pair 26 (S102: NO), the processor 90 waits until it is determined that the paper sheet P has arrived.

On the other hand, when the leading end of the paper sheet P has arrived at the registration roller pair 26 (S102: YES), successively, the processor 90 determines whether the paper sheet P having arrived at the registration roller pair 26 is a sheet having come from the duplex conveyance pathway 63 (S103). Herein, whether a sheet has come from the duplex conveyance pathway 63 may be determined based on whether each of the conveyance roller pairs on the duplex conveyance pathway 63 is driven or not.

Here, in the case where the paper sheet P has come from the duplex conveyance pathway 63 (S103: YES), the processor 90 instructs the motors LM and DM1 to DM4 on the duplex conveyance pathway 63 to start deceleration (S104).

Successively, the processor 90 determines whether the deceleration has been finished (S105). If the deceleration has not been finished (S105: NO), the processor 90 waits until the deceleration has been finished. During a period until the deceleration has been finished, the paper sheet P is further pushed by the rotation of each of the loop roller pair 25 and the duplex conveyance roller pairs 37 to 43 in a state of being brought in contact with the registration roller pair 26 having stopped, whereby a loop is formed on the paper sheet P between the registration roller pair 26 and the loop roller pair 25. At this time, as having already described, secondary loops are formed on the portions other than the portion between the registration roller pair 26 and the loop roller pair 25.

In the case where the processor 90 determines in S105 that the deceleration has been finished (S105: YES), successively, the processor 90 determines whether the length (sheet length) of the paper sheet P exceeds a specified value A (the specified value A is not included) (S106). In a state where the leading end of the paper sheet P comes in contact with the registration roller pair 26, the specified value A is a length with which the trailing end does not reach the sixth duplex conveyance roller pair 42. In concrete terms, for example, the specified value A is the length of the short side of an A4 size sheet (the same in the below). With regard to this determination, the processor 90 may determine by acquiring the size of the paper sheet P from a job ticket (printing contents) of the job currently being printed.

In the case where the processor 90 determines in S106 that the sheet length does not exceed the specified value A (S106: NO), the process is shifted to S109, and the exciting current for the motor DM4 is cut off (excitation OFF) (S109). At this time, the flowing of the exciting current for each of the motors located on the upstream side than the motor DM4 is continued. With this, the restarting can be made earlier than the case where the exciting current for each of the other motors is turned OFF.

On the other hand, in the case where the processor 90 determines in S106 that the sheet length exceeds the specified value A (S106: YES), the exciting current for the motor DM3 is cut off (S107). Successively, the processor 90 waits until the excitation OFF time ta has elapsed (S108). The excitation OFF time ta in S108 is the time t0 wait for the elimination of the restoring force caused by the secondary loop between the seventh duplex conveyance roller pair 43 and the sixth duplex conveyance roller pair 42. Herein, if the excitation OFF time ta has not been elapsed (S108: NO), the processor 90 waits until the excitation OFF time ta has elapsed. On the other hand, in the case where the excitation OFF time ta has elapsed from the start of the exciting current OFF for the motor DM3 (S108: YES), successively, the processor 90 cuts off the exciting current for the motor DM4 (S109).

Successively, the processor 90 waits until the excitation OFF time ta has elapsed (S110). The excitation OFF time ta in S110 is the time t0 wait for the elimination of the restoring force caused by the secondary loop between the loop roller pair 25 and the seventh duplex conveyance roller pair 43. Here, for example, the excitation OFF time ta in S108 and the excitation OFF time ta in S110 are made the same with each other.

Successively, the processor 90 makes the exciting current to flow into each of the motors DM3 and DM4 (excitation ON) (S111). At this time, in the case where the process proceeds from S106 into S109, the exciting current for the motor DM3 is maintained in the energized state (excitation ON state).

Successively, the processor 90 waits until the pre-excitation time tb of each of the motors DM3 and DM4 has elapsed (S112). Herein, if the time tb has not elapsed (S112: NO), the processor 90 waits until the pre-excitation time tb has elapsed. Herein, strictly speaking, the respective pre-excitation times of the motors DM3 and DM4 are slightly different from each other depending on the kind of the motor and the oscillating condition of the apparatus. However, the difference is small. For this reason, herein, the processor 90 is made to wait until the pre-excitation time tb of the motor with the longest pre-excitation time tb. In the case of controlling the difference strictly, in the case where the process has proceeded from S106 to S109 and then comes to S112, the processor 90 waits until the pre-excitation time tb of the motor DM4 has elapsed. On the other hand, in the case where the process has proceeded from S106 through S107 and S108, and then comes to S112, the processor 90 waits until the pre-excitation time tb of each of the motors DM3 and DM4 has elapsed.

Successively, in the case where the elapsed time of each motor from the exciting current ON has passed the pre-excitation time tb (S112: YES), the processor 90 starts the rotation of each of the motors RM, LM, DM3, and DM4 (S113). With this, the processes are ended. After the processes have been ended, in order to print the next paper sheet P, control is started from S101 (in the other procedures, the control after the processes have been ended, is the same).

In the case where the sheet length of the paper sheet P is the specified value A or less (S106: NO), a flag showing this situation is made to stand, and the control for the motor DM3 may not be performed. For example, in the case where the flag showing that S106 is NO, is standing, in S113, the rotation of only the motor DM4 is started (the motor DM3 is not rotated). The reasons are as follows. The situation that S106 is NO means that a paper sheet does not exist on the portion of the sixth duplex conveyance roller pair 42. Accordingly, there is no need to rotate the motor DM3.

By the processes so far, in the case where the secondary loops are formed at the time of printing a thick paper sheet conveyed though the duplex conveyance pathway 63, it is possible to prevent or suppress the occurrence of sheet displacement caused by the restoring force of the above secondary loops.

Next, description is given to a case (S103: NO) where the paper sheet P is conveyed from the sheet feed conveyance pathway 61, in S103. In this case, only the motors becoming the control target are different, and the processing contents are the same as those in the case of the duplex conveyance pathway 63. For this reason, a part of the description is omitted.

In S103, in the case where the paper sheet P has been conveyed from the sheet feed conveyance pathway 61 (S103: NO), the processor 90 instructs the motors LM, MM1, and MM2 on the sheet feed conveyance pathway 61 to start deceleration (S124).

Successively, the processor 90 determines whether the deceleration has been finished. In the case where it has been determined that the deceleration has been finished (S125: YES), successively, the processor 90 determines whether the length (sheet length) of the paper sheet P exceeds a specified value A (the specified value A is not included) (S126). In a state where the leading end of the paper sheet P comes in contact with the registration roller pair 26, the specified value A is a length with in which the trailing end does not reach the first intermediate conveyance roller pair 23.

In the case where the processor 90 determines that the sheet length does not exceed the specified value A (S126: NO), the process is shifted to S129, and the exciting current for the motor MM2 is cut off (S129). At this time, the exciting current for the motor MM1 is maintained at ON.

On the other hand, in S126, in the case where the processor 90 determines that the sheet length exceeds the specified value A (S126: YES), the exciting current for the motor MM1 is cut off (S127). Successively, the processor 90 waits until the excitation OFF time ta required for the disappearing of the restoring force of the paper sheet has elapsed (S128). Herein, the excitation OFF time ta may be the same as that mentioned in S108 and S110. In the case where the excitation OFF time ta has elapsed from the start of the exciting current OFF for the motor MM1 (S128: YES), successively, the processor 90 cuts off the exciting current for the motor MM2 (S129).

Successively, the processor 90 waits until the excitation OFF time ta required for the disappearing of the restoring force of the paper sheet has elapsed (S130). The excitation OFF time ta in S130 may be the same as the excitation OFF time ta in S128 (hereafter, the same).

Successively, the processor 90 makes the exciting current flow into each of the motors MM1 and MM2 (S131). At this time, in the case where the process proceeds from S126 to S129, the exciting current for the motor MM1 is maintained to be in the state of ON.

Successively, the processor 90 waits until the pre-excitation time tb of each of the motors MM1 and MM2 has elapsed (S132). If the elapsed time of each motor from the exciting current ON has passed the pre-excitation time tb (S132: YES), the processor 90 starts the rotation of each of the motors RM, LM, MM1, and MM2 (S133). With this, the processes are ended.

Here, also in the case where the sheet length of the paper sheet P is the specified value A or less (S126: NO), a flag showing this situation is made to stand, and hereinafter, the control for the motor MM1 may not be performed. For example, in the case where S126 is NO, in S133, the rotation of only the motor MM2 is started (the motor MM1 is not rotated).

By the processes so far, in the case where the secondary loops are formed at the time of printing a thick paper sheet conveyed through the sheet feed conveyance pathway 61, it is possible to prevent or suppress the occurrence of sheet displacement caused by the restoring force of the above secondary loops.

According to the present Embodiment 1, effects described below can be attained.

In the present Embodiment 1, a paper sheet P is brought in contact with the registration roller pair 26, whereby a loop is formed, and the conveyance of the paper sheet P is stopped. Thereafter, an exciting current for each of motors to drive a plurality of conveyance roller pairs located on the upstream side than the loop roller pair 25 has been decided to be cut off. At this time, a timing to cut off an exciting current for at least one of the motors is made different from the timings for the other motors. With this, since the load imposed on the motor can be released, out of synchronization at the time of restarting the conveyance of the paper sheet P is suppressed or prevented, and the conveyance of a paper sheet can be performed appropriately. In addition, since an exciting current for at least one of the motors is cut off with a different timing, the restoring forces of the paper sheet are gradually released. Accordingly, the paper sheet is not displaced by the force when the restoring force is released.

Moreover, the exciting currents are cut off in an order from the exciting current for the motor used for driving the conveyance roller pair located on the more upstream side. Accordingly, the secondary loops formed among a plurality of conveyance roller pairs located on the upstream side than the loop roller pair 25 are gradually eliminated, and finally, all the secondary loops are eliminated. With this, the load imposed on the motor of each of the conveyance roller pairs due to the restoring force of the secondary loops can be reduced or eliminated. Therefore, even if the paper sheet is a thick paper sheet with high stiffness, it is possible to prevent out of synchronization from occurring at the time of restarting after the registration. Moreover, since exciting currents are cut off in the order from the upstream side, restoring forces are gradually released from the trailing end side of the paper sheet. Accordingly, in particular, in the case where the paper sheet is a thick paper sheet, the paper sheet is not displaced with the force when the restoring forces are released.

Embodiment 2

Embodiment 2 is different from Embodiment 1 only in terms of a control mode, and the constitution of an image forming apparatus is the same as that in Embodiment 1. Accordingly, description for the apparatus constitution is omitted.

In Embodiment 2, an order to cut off exciting currents for the motors is changed in accordance with the thickness and stiffness of a paper sheet.

Figure 10:
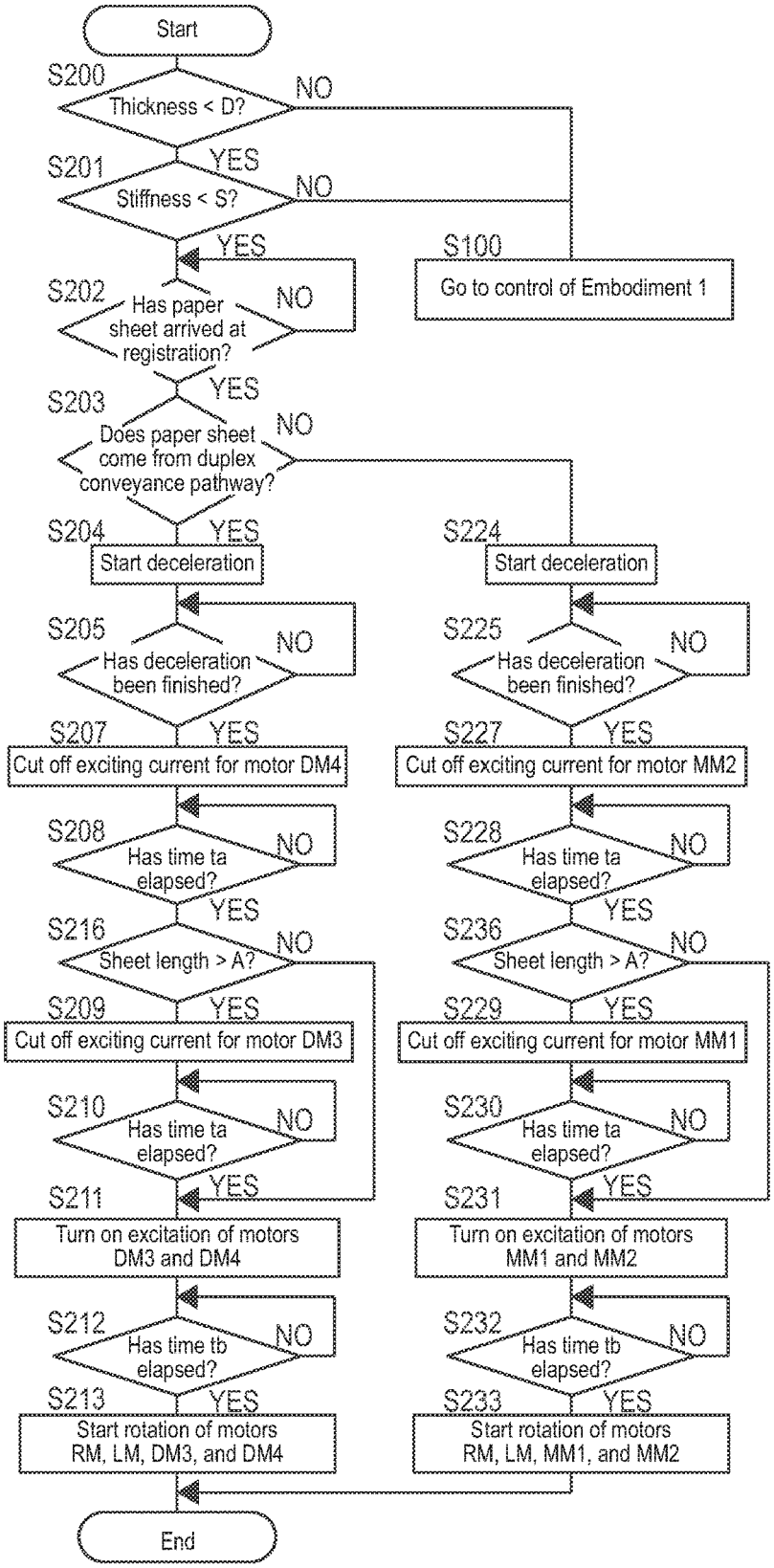
FIG. 10 is a flow chart showing control procedures for the image forming apparatus according to Embodiment 2.

FIG. 10 is a flowchart showing the control procedures for the image forming apparatus according to Embodiment 2.

The control procedures are executed by the processor 90. Since a part of processes is the same as that in Embodiment 1, description for the part is omitted.

In the present Embodiment 2, first, the processor 90 determines whether the thickness of the paper sheet P currently being conveyed is less than a specified value D (thickness <D) (S200). For example, the specified value D of the thickness of a paper sheet is made 0.3 mm.

Here, in the case where the thickness of the paper sheet P is not less than the specified value D (S200: NO), the control (FIG. 9) in Embodiment 1 is executed. That is, in this case, since the thickness of the paper sheet P is thick, there is a possibility that high load is imposed on the conveyance system. Accordingly, the control in Embodiment 1 is performed (S100).

On the other hand, in S200, in the case where the processor 90 determines that the thickness of the paper sheet P is less than the specified value D (S200: YES), furthermore, the processor 90 determines whether the stiffness of the paper sheet P is less than the specified value S (S201). With this determination in S201, although the thickness of the paper sheet is comparatively thin, it can be determined whether the paper sheet is a paper sheet with high stiffness. The specified values S of the stiffness is, for example, 400 mN·m. Here, if the stiffness of the paper sheet P is not less than the specified value S (S201: NO), the control (FIG. 9) in Embodiment 1 is performed (S100). That is, in this case, since the stiffness of the paper sheet P is high, there is a possibility that high load is imposed on the conveyance system. Accordingly, the control in Embodiment 1 is performed.

On the other hand, in S201, in the case where the processor 90 determines that the stiffness of the paper sheet P is less than the specified value S (S201: YES), the processing proceeds to the processes after S202. That is, in the case it is determined that S201 is YES, it means that the thickness of the paper sheet P is thin and its stiffness is comparatively low. For example, the paper sheet P with a thickness of 0.2 mm and a stiffness of 300 mN·m corresponds to the above case.

In the processes after S202, the processes from S202 to S205 are the same processes from S102 to S105 in Embodiment 1. That is, the processor 90 performs the determination whether the leading end of the paper sheet P has arrived at the registration roller pair 26 (S202), determination whether the paper sheet P is a paper sheet P having come from the duplex conveyance pathway 63 (S203), to perform the starting of deceleration (S204), and the determination whether the deceleration has been finished (S205).

Then, in S205, in the case where it is determined the deceleration has been finished (S205: YES), in the present Embodiment 2, the processor 90 cuts off the exciting current for the motor DM4 (S207). Successively, similarly to Embodiment 1, the processor 90 waits until the excitation OFF time ta has elapsed (S208). Here, if the excitation OFF time ta has not elapsed (S208: NO), the processor 90 waits until the excitation OFF time ta has elapsed.

In the case where the excitation OFF time ta has elapsed (S208: YES), the processor 90 determines whether the length (sheet length) of the paper sheet P exceeds the specified value A (the specified value A is not included) (S216).

In S216, in the case where the processor 90 determines that the sheet length does not exceed the specified value A (S216: NO), the process is shifted to S211, and an exciting current is made to flow into each of the motor DM3 and the motor DM4 (S211).

On the other hand, in S216, in the case where the processor 90 determines that the sheet length exceeds the specified value A (S216: YES), the exciting current for the motor DM3 is cut off (S209). That is, in the case where the sheet length is longer than the specified value A, the exciting current for the motor DM3 is cut off.

Successively, the processor 90 waits until the excitation OFF time ta has elapsed (S210).

Successively, the processor 90 makes the exciting current flow into each of the motors DM3 and DM4 (S211).

Successively, similarly to Embodiment 1, the processor 90 waits until the pre-excitation time tb of each of the motors DM3 and DM4 has elapsed (S212), and then the processor 90 starts the rotation of each of the motors RM, LM, DM3, and DM4 (S213). With this, the processes are ended.

Next, description is given to a case (S203: NO) where the paper sheet P is conveyed from the sheet feed conveyance pathway 61, in S203. In this case, only the motors becoming the control target are different, and the processing contents are the same as those in the case of the duplex conveyance pathway 63.

In S203, in the case where the paper sheet P has been conveyed from the sheet feed conveyance pathway 61 (S203: NO), the processor 90 starts deceleration of each of the motors MM1 and MM2 on the sheet feed conveyance pathway 61 (S224). Subsequently, after the deceleration has been finished (S225: YES), the processor 90 cuts off the exciting current for the motor MM2 (S227).

Successively, the processor 90 wait until the excitation OFF time ta has elapsed (S228). In the case where the excitation OFF time ta has elapsed (S228: YES), successively, the processor 90 determines whether the length (sheet length) of the paper sheet P exceeds the specified value A (the specified value A is not included) (S236).

In the case where the processor 90 determines in S106 that the sheet length does not exceed the specified value A (S236: NO), the process is shifted to S231 and an exciting current is made to flow into each of the motors MM1 and MM2 (S231).

On the other hand, in the case where the sheet length exceeds the specified value A (S236: YES), the exciting current for the motor MM1 is cut off (S229).

Successively, the processor 90 waits until the excitation OFF time t0 has elapsed (S230). Successively, the processor 90 makes the exciting current flow into each of the motors MM1 and MM2 (S231).

Successively, the processor 90 waits until the pre-excitation time tb of each of the motors MM1 and MM2 has elapsed (S232). In the case where the pre-excitation time tb has elapsed (S232: YES), the processor 90 starts the rotation of each of the motors RM, LM, MM1, and MM2 (S233).

The determination (S216 or S236) as to whether the sheet length of the paper sheet P exceeds the specified value A may be made at any step position as long as the position is before the step to cut off the exciting current for the motor DM3 or the motor MM1. For example, a flag showing the situation that the sheet length of the paper sheet P is the specified value A or less is made to stand, and on and after, the control for the motor DM3 or MM1 may not be performed.

In this way, in the present Embodiment 2, even in the case where the paper sheet P is not a thick paper sheet, the exciting current for the motor to drive a conveyance roller pair has been decided to be cut off. With this, also in the case where the paper sheet P is a comparatively thin paper sheet, the load imposed on a conveyance roller pair can be reduced. However, different from Embodiment 1, in the present Embodiment 2, the exciting current may be cut off from any motor. In the present Embodiment 2, the exciting current has been decided to be cut off from the motor located on the side near the loop roller pair 25. With this, since it is possible to make an exciting current flow in an order from the motor located on the side (downstream side) nearer to the loop roller pair 25 at the time of restarting, timing of starting rotation can be advanced correspondingly to it.

Moreover, in the present Embodiment 2, since each of the stiffness and thickness is individually determined, even if the basis weight is the same, the control in Embodiment 1 can be performed even for a sheet in which the thickness may be thick or the stiffness may be high depending on the quality of the paper sheet. For example, in a coated paper sheet and a resin film used as a sheet (print media), even if their basis weight becomes the same as a regular paper sheet, their thickness or stiffness may be different. As in the present Embodiment 2, by determining based on items other than the basis weight, in various kinds of sheets (print media), it becomes possible to reduce the load imposed on each of the conveying roller pairs at the time of the restarting after having brought the paper sheet in contact with the registration roller pair. As a result, it becomes possible to prevent out of synchronization at the time of the restarting.

In the present Embodiment 2, the case where the paper sheet exists over on the two conveyance roller pairs has been described as an example. However, in the case where the sheet length is further longer and the paper sheet exists over on three or more conveyance roller pairs, and in the case where each of the motors to drive the three or more conveyance roller pairs is independent from others, the order of the motors to cut off exciting currents may be any order.

For example, among three motors, the exciting current for a motor located between the downstream side and the upstream side may be cut off first, and the exciting current for each of the two other motors may be cut off later. That is, although a paper sheet is a thick paper sheet, in the case where the paper sheet is a comparatively thin paper sheet than other thick paper sheets, the restoring force of secondary loops on the paper sheet become lower than the other thick paper sheet. Accordingly, even if the exciting currents for the motors are cut off in any order, the secondary loops are gradually released. Therefore, as compared with a case where the exciting currents for all the motors are cut off simultaneously so as to release the restoring forces by all the secondary loops simultaneously, the force in the present Embodiment 2 becomes small.

Moreover, the criterion of determination for each of the thickness (S200) and the stiffness (S201) may be set arbitrarily, and may be set to a thickness or a stiffness with which it is expected that a high load is imposed on a conveyance system (mainly conveyance roller pairs 23 to 24 and 37 to 43).

Embodiment 3

Embodiment 3 is different from Embodiment 1 only in terms of a control mode, and the constitution of an image forming apparatus is the same as that in Embodiment 1. Accordingly, description for the apparatus constitution is omitted.

In recent years, speeding up of the image forming process has been attempted, and it is required to shorten the stopping time for loop formation. Embodiment 3 is a mode to make it possible to start rotation further earlier while being eliminating secondary loops.

Figure 11:
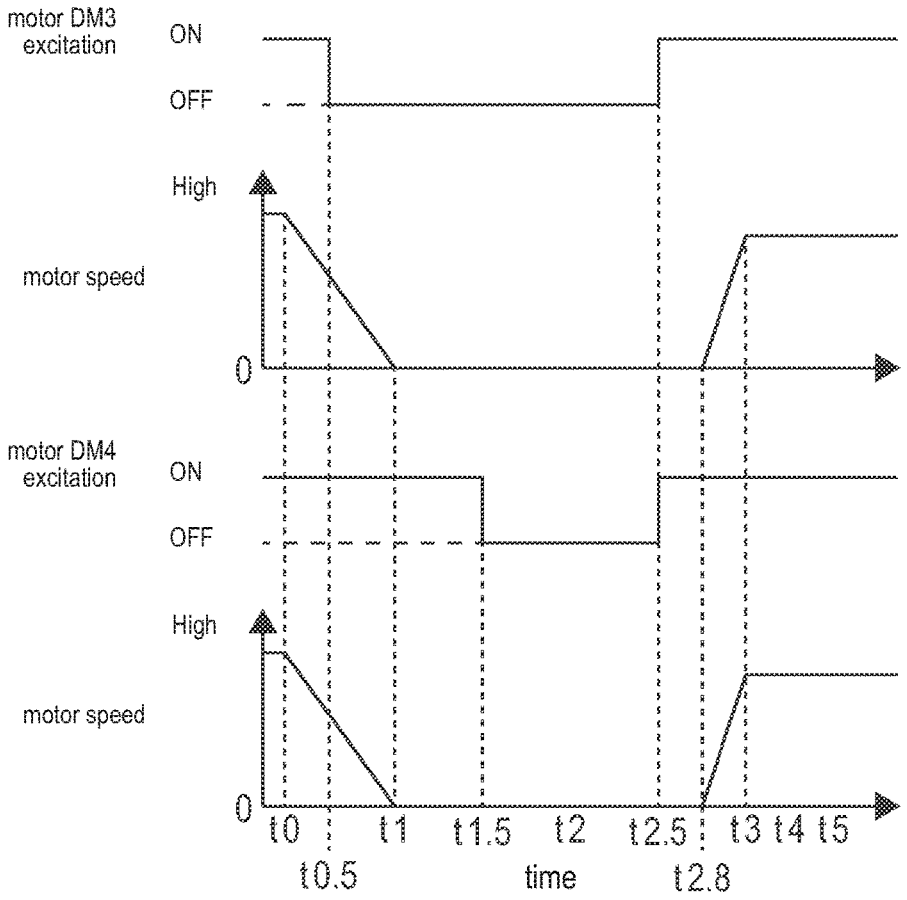
FIG. 11 is a time chart showing an operation timing of each of motors DM3 and DM4 in Embodiment 3.

FIG. 11 is a time chart showing an operation timing of each of the motors DM3 and DM4 according to Embodiment 3.

In the present embodiment 3, when the leading end of the paper sheet P arrives at the registration roller pair 26 and deceleration is started (t0), the motor DM3 and the motor DM4 are made to decelerate at the same timing at the same deceleration rate. At time t0.5 in the middle of deceleration, the exciting current for the motor DM3 is cut off. At this time, the motor DM3 is made to stop, and the static torque is released so that the motor DM3 becomes a state capable of rotating freely. After that, at time t1, the deceleration has been finished, and motor DM4 stops. After time t0.5, until being re-excited, the static torque does not exist on the motor DM3. For this reason, in the sixth duplex conveyance roller pair 42, the conveyance force for the paper sheet P is lost. On the other hand, since conveyance is continued by the seventh duplex conveyance roller pair 43 and the loop roller pair 25, a loop is formed between the registration roller pair 26 and the loop roller pair 25. With this, a secondary loop is not formed between the sixth duplex conveyance roller pair 42 and the seventh duplex conveyance roller pair 43.

Furthermore, in the present Embodiment 3, at time t1, since the sixth duplex conveyance roller pair 42 is in s state capable of rotating freely (because the exciting current for the motor DM3 has been cut off), there is no need to wait for elimination of the restoring force by a secondary loop. Accordingly, at t1.5 earlier than t2, the exciting current for the motor DM4 can also be cut off. Subsequently, similarly to Embodiment 1, the processor 90 waits only for the time necessary for eliminating the secondary loop between the loop roller pair 25 and the seventh duplex conveyance roller pair 43, and then, at time t2.8, the processor 90 starts rotation of each of the motors DM3 and DM4 (also starts the motors RM and LM synchronously). Then, the interval between time t2.5 and time t2.8 becomes the pre-excitation time. After that, from t2.8, the motors DM3 and DM4 are accelerated, and at time t3, the speed of each of the motors DM3 and DM4 becomes the process speed for printing.

In this way, in the present Embodiment 3, the excitation of the motor DM3 disposed on the more upstream side is cut off in the middle of the deceleration, whereby the restarting of the excitation of each of the two motors can be made earlier up to a time point of t3.

The present Embodiment 3 can be applied to not only the duplex conveyance pathway 63, but also to the sheet feed conveyance pathway 61. In the case where the present Embodiment 3 is applied to the sheet feed conveyance pathway 61, since the timing of turning ON or OFF the exciting current for each of the motors MM1 and MM2 is the same as the time chart shown in FIG. 11, description is omitted.

Figure 12:
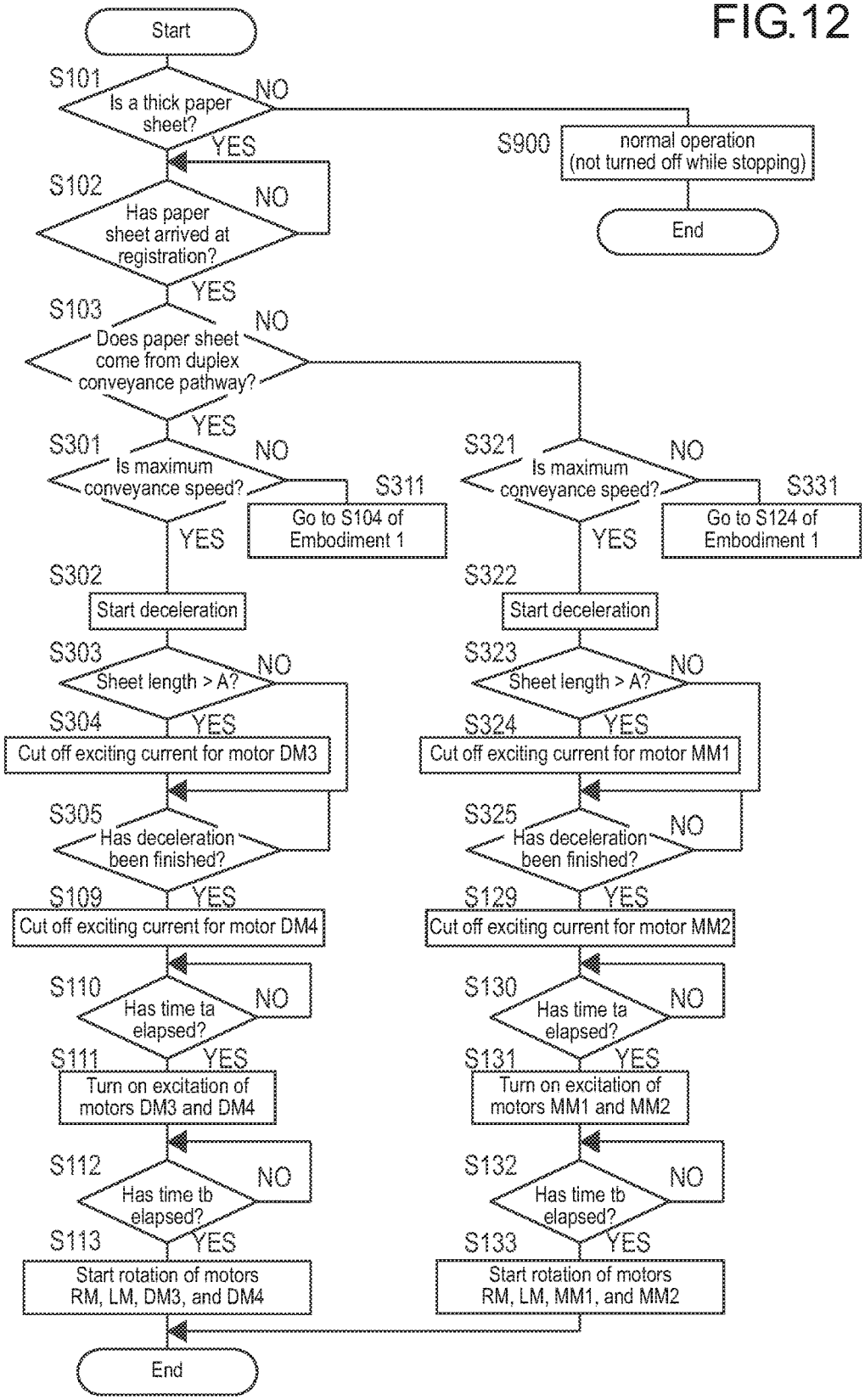
FIG. 12 is a flow chart showing control procedures for the image forming apparatus according to Embodiment 3.

Next, the control procedures according to the present Embodiment 3 are described. FIG. 12 is a flowchart showing the control procedure for the image forming apparatus according to Embodiment 3.

The control procedures are executed by the processor 90. The control procedures in Embodiment 3 include a portion becoming the same procedure in Embodiment 1. Accordingly, for such a portion, the same step number as that in Embodiment 1 is given, and description for the portion is omitted.

The processes from S101 to S103 are the same processes as those in Embodiment 1. In S103, if printing is for a sheet from the duplex conveyance pathway 63 (S103: YES), the processor 90 determine whether the sheet conveyance speed of the duplex conveyance pathway 63 is a maximum conveyance speed (details will be described later) (S301). If the conveyance speed is not the maximum conveyance speed here (S301: NO), the process is shifted to S104 in Embodiment 1 (S311), and the processes after it are performed. This is because there is a possibility that in the case where the sheet conveyance speed is not the maximum conveyance speed, if the excitation current for the motor DM3 on the upstream side is cut off in the middle of the deceleration, the trailing end of the paper sheet may not be conveyed sufficiently (there is a possibility that a loop may be not formed). For this reason, the processes after S104 in Embodiment 1 are performed, whereby the motors DM3 and DM4 are driven until the deceleration has been finished (the state of the excitation ON is continued). On the other hand, if the conveyance speed is the maximum conveyance speed (S301: YES), even if the exciting current for the motor DM3 that is driving the conveyance roller pairs 40 to 42 on the upstream side is cut off in the middle of the deceleration, since the paper sheet maintains the sufficient speed, the trailing end portion will be also conveyed by a distance needed for loop formation. Moreover, even if the conveyance speed is the maximum conveyance speed, since the paper sheet is a thick paper sheet and the leading end comes in contact, the restoring force of the paper sheet works. Accordingly, the paper sheet is applied with a brake so that the trailing end of the paper sheet does not proceed forward more than necessary. Moreover, position control is performed with the loop roller pair 25 located on the most downstream side, the accuracy of the leading end of the paper sheet does not deteriorate. In this embodiment, it is decided to determine whether the conveyance speed is the maximum conveyance speed. However, in place of this, for example, if the conveyance speed is 50% or more of the maximum conveyance speed, the exciting current for the motor on the upstream side may be cut off in the middle of the deceleration.

In the case where the conveyance speed is the maximum conveyance speed (S301: YES) (S302), successively, the processor 90 determines whether the deceleration of each of the motors DM3 and DM4 on the duplex conveyance pathway 63 has been started. If the deceleration of each of the motors DM3 and DM4 has not been started, the processor 90 waits until the deceleration of each of the motors DM3 and DM4 is started.

In the case where the deceleration of the motors DM3 and DM4 has been started, the processor 90 determines whether the length (sheet length) of the paper sheet P exceeds the specified value A (the specified value A is not included) (S303).

In the case where the processor 90 determines that the length of the paper sheet P does not exceed the specified value A (S303: NO), the process is shifted to S305.

On the other hand, in the case where the processor 90 determines in S303 that the length of the paper sheet P exceeds the specified value A (S303: YES), the processor 90 cuts off the exciting current for the motor DM3 on the upstream side (S304). That is, the exciting current for the motor DM3 is made to be cut off in the middle of the deceleration.

Successively, the processor 90 determines whether the deceleration has been finished (S305). If he deceleration has not been finished (S305: NO), the processor 90 waits until the deceleration has been finished. During a period before the deceleration has been finished, a loop is formed on the paper sheet P between the registration roller pair 26 and the loop roller pair 25.

In S305, if it is determined that the deceleration has been finished (S305: YES), the processor 90 cuts off the exciting current for the motor DM4 (S109). Subsequently, from S110 to S113, the same processes as those in Embodiment 1 are performed.

In S103, also in the case where the paper sheet has been conveyed from the sheet feed conveyance pathway 61 (S103: NO), similarly to the case of the duplex conveyance pathway 63, it is determine whether the conveyance speed is the maximum conveyance speed (S321). Then, if the conveyance speed is not the maximum conveyance speed, the process is shifted to S124 in Embodiment 1 (S331), and the processes after it are performed. In the case where the conveyance speed is the maximum conveyance speed (S321: YES), after the deceleration for each of the motors LM, MM1, and MM2 has been started (S322), if the sheet length of the paper sheet P does not exceed the specified value A (S323: NO), the process is shifted to S325. On the other hand, in the case where if the sheet length of the paper sheet P exceeds the specified value A (S323: YES), the processor 90 cuts off the exciting current for the motor MM1 on the upstream side (S324).

Successively, the processor 90 determines whether the deceleration has been finished, in the case where the deceleration has been finished (S325: YES), the processor 90 cuts off the exciting current for the motor MM2 (S129). Thereafter, the processes from S129 to 133 are performed similarly to Embodiment 1.

As described in the above, in the present Embodiment 3, the exciting current for the motor located on the upstream side is decided to be cut off from the middle of the deceleration, corresponding to it, the timing of cutting off the exciting current for the motor located on the downstream side can be advanced. As a result, the timing of starting the rotation of the motors can be advanced. Therefore, the rotation of the motors after the restarting can be started further earlier while being eliminating secondary loops.

Embodiment 4

Embodiment 4 is different from Embodiment 1 only in terms of a control mode, and the constitution of an image forming apparatus is the same as that in Embodiment 1. Accordingly, description for the apparatus constitution is omitted.

Embodiment 4 is also a mode to make it possible to start rotation further earlier while being eliminating secondary loops.

When the exciting current for a motor to drive a conveyance roller pair is cut off, as has already described, a static torque is released so that the motor is made to rotate freely. At this time, since a part of the paper sheet moves in a direction toward the upstream side when the secondary loop is released, pared rollers of the conveyance roller pair are rotated, and the motor also is rotated along with the rotation. At this time, counter electromotive force is generated. Then, it is decided to monitor this counter electromotive force and to control the exciting current of the motor. The monitoring of the counter electromotive force can be performed, for example, by measuring the output voltage of the common power source to supply electric power for each of the motors. If the counter electromotive force is generated, the output voltage rises. As the other techniques, based on information from driver ICs to drive the motors, the counter electromotive force (or voltage fluctuation of a motor) of each motor may be detected individually and used. In this case, by detecting a situation that the counter electromotive force of at least one motor has risen once and then lowered, at that time point, the exciting current for each of the other motors will be cut off.

Figure 13:
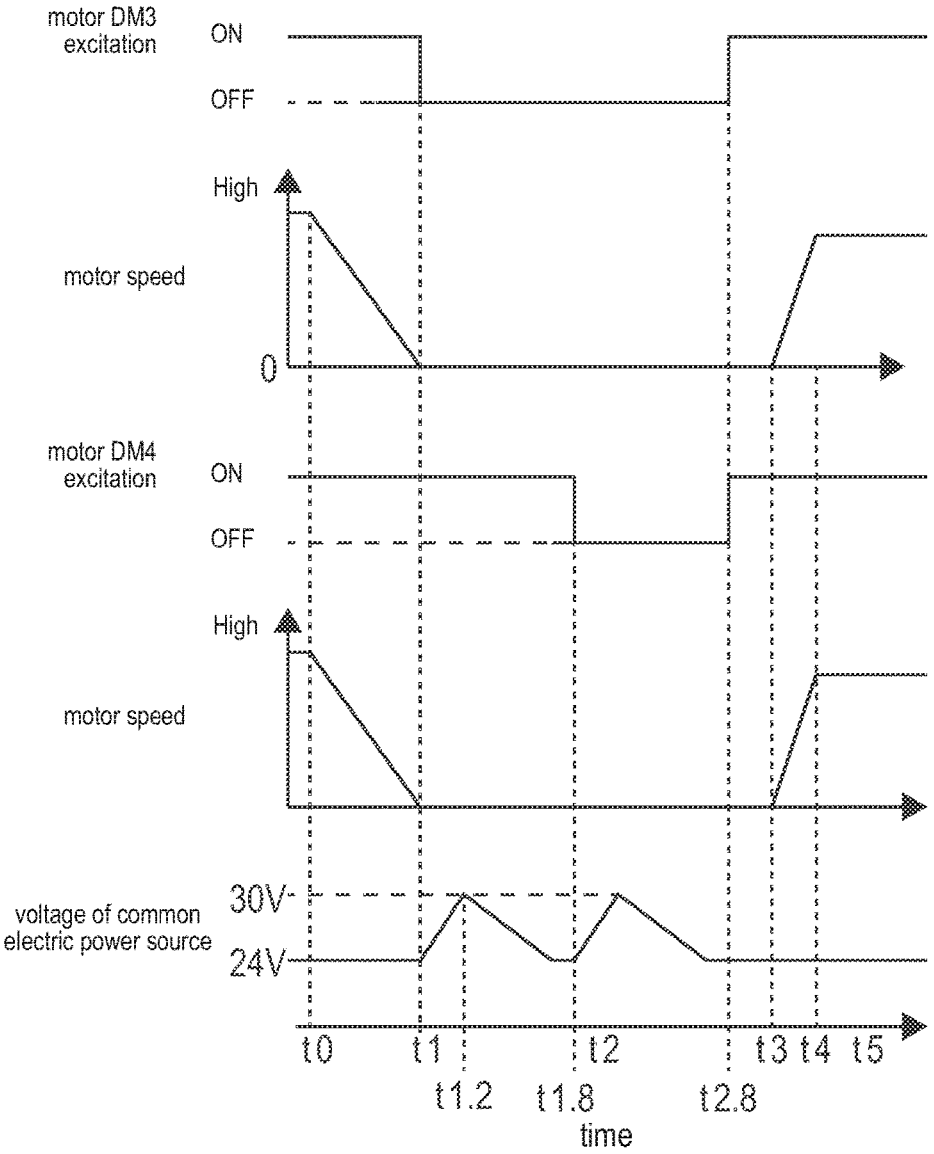
FIG. 13 is a time chart showing an operation timing of each of motors DM3 and DM4 in Embodiment 4.

FIG. 13 is a time chart showing the timing of operation of each of the motors DM3 and DM4 in Embodiment 4. Similarly to FIG. 6, ON and OFF of an exciting current for a motor on an upstream side and a motor on an downstream side and a speed are shown at the upper stage and the middle stage, and the voltage of the common electric power source to supply electric power to the motors is shown at the lower stage.

first, at the stage of time t0, the leading end of the paper sheet P arrives at the registration roller pair 26, and deceleration is started. The motor DM3 and the motor DM4 are made to decelerate at the same timing at the same deceleration rate. Then, at time t1, the motor DM3 and the motor DM4 stop. While the paper sheet P is conveyed at a decelerated speed during a period from the time t0 to the time t1, a loop is formed between the registration roller pair 26 and the loop roller pair 25. At a time point of time t1, the deceleration has been finished, and the motor DM3 and the motor DM4 stop. Simultaneously with the stop of the motor DM3, the exciting current for the motor DM3 is cut off. With this, the static torque on the motor DM3 is released so that the fourth to sixth duplex conveyance roller pairs 40 to 42 can rotate freely. At this time point, the motor DM4 located nearer to the loop roller pair 25 is in a state where the exciting current is made to flow into it and the static torque is working effectively. Until this time point (t1), as the voltage of the electric power of the common electric power source, the voltage of the electric power supplied to the motor is output without any change, for example, the voltage is 24 V.

After that, the motor DM3 is rotated reversely by the restoring force of the paper sheet P so that counter electromotive force is generated. Accordingly, the counter electromotive force is added to the voltage of the common power supply so that, for example, the voltage rises to about 30V (t1.2). Thereafter, when the restoring force of the paper sheet is released, since the reverse rotation is lost, the voltage of the common power supply returns to 24V.

Then, at time t1.8 when the counter electromotive force has been lost, the exciting current for the motor DM4 is cut off. With this, the static torque on the motor DM4 is released, and the seventh duplex conveyance roller pair 43 can rotate freely. At this time, similarly, the voltage of the common power supply rises by counter electromotive force. Subsequently, since the counter electromotive force disappears at a time point of time t2.8, a secondary loop is deemed to be eliminated sufficiently, and the exciting current is made to flow into each of the motors DM3 and DM4.

Thereafter, at time t3, the rotation of each of the motors DM3 and DM4 is started (the motors RM and LM are also started synchronously). Then, each of the motors DM3 and DM4 is accelerated, and at time t4, the speed of each of them becomes the process speed for printing.

The present Embodiment 4 can be applied not only to the duplex conveyance pathway 63, but also to the sheet feed conveyance pathway 61. The timing of turning ON or OFF the exciting current for each of the motors MM1 and MM2 in the case of applying the present Embodiment 4 to the sheet feed conveyance pathway 61 is the same with that in the time chart shown in FIG. 13. Accordingly, description for this is omitted.

Figure 14:
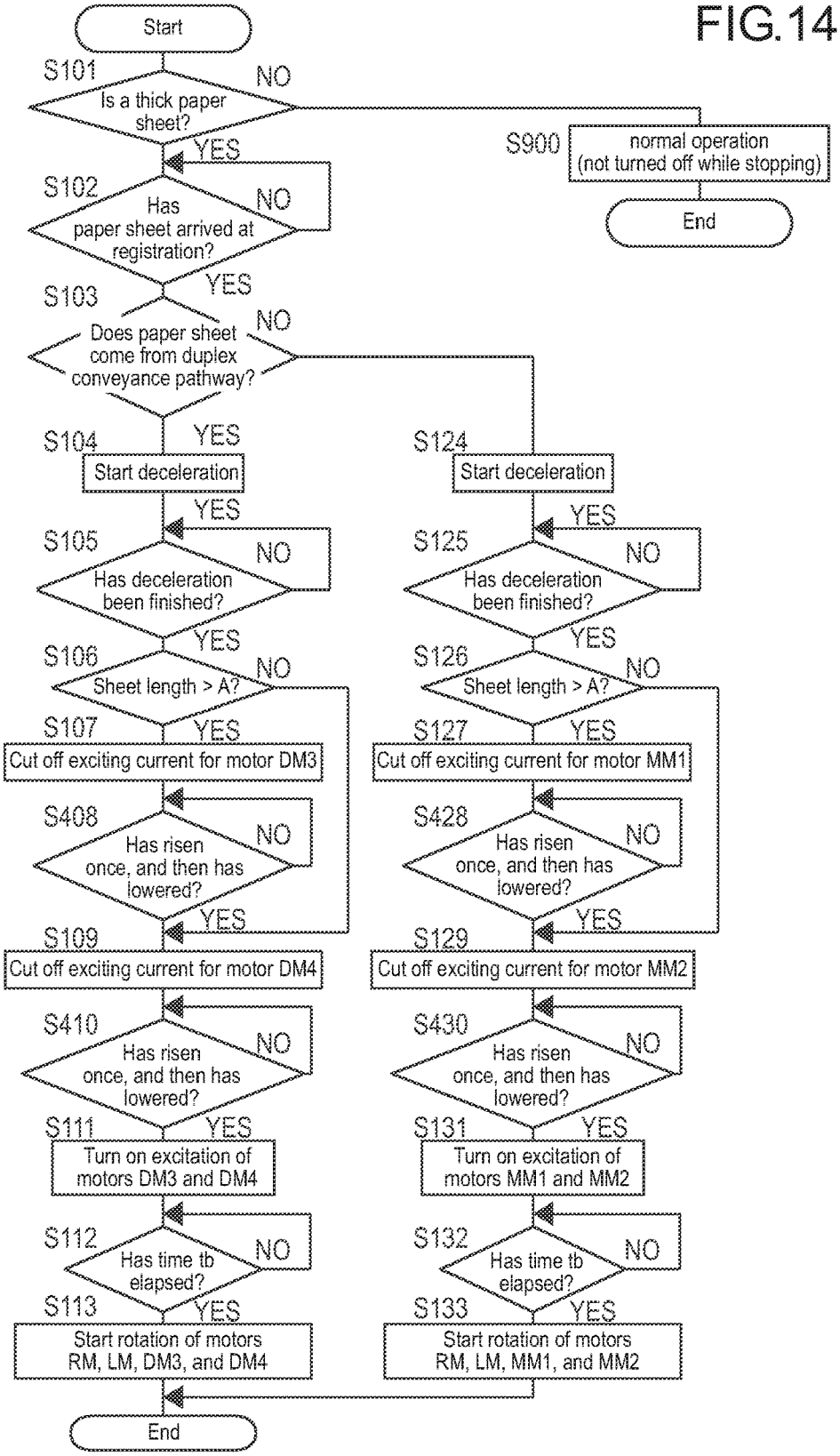
FIG. 14 is a flow chart showing control procedures for the image forming apparatus according to Embodiment 4.

Next, the control procedures according to the present Embodiment 4 are described. FIG. 14 is a flowchart showing the control procedures for the image forming apparatus according to Embodiment 4.

The control procedures are executed by the processor 90. In the control procedure of the present Embodiment 4, S108, S110, S128, and S130 in Embodiment 1 are made processes peculiar to the present embodiment 4, and the other processes are the same processes in Embodiment 1. The same process is provided with the same step number, and description for it is omitted.

In the present Embodiment 4, the processor 90 is monitoring the voltage of the common power source. Then, in the duplex conveyance pathway 63, after having cut off the exciting current for the motor DM3 in S107, the processor 90 determines whether the voltage of the common power source has risen once, and then has lowered (S408). Here, if the voltage of the common power source has not risen once, and then has not lowered (S408: NO), the processor 90 waits for such a situation. On the other hand, in the case where the voltage of the common power source has risen once, and then has lowered, the processor 90 cuts off the exciting current for the motor DM4 (S109).

Furthermore, successively, in S410, the processor 90 determines whether the voltage of the common power source has risen once, and then has lowered (S410). Then, in the case where the voltage of the common power source has risen once, and then has lowered, the processor 90 makes the exciting current flow into each of the motors DM3 and DM4 (S111).

Also, on the sheet feed conveyance pathway 61, the same processes are performed in S428 and S430.

As described above, in the present Embodiment 4, it is decided to determine based on the voltage related to the common power source whether the secondary loops have been eliminated, and then, based on the resultant determination, it is decided to cut off or introduce an exciting current for the motor. Therefore, the processes from the stopping of conveyance to the restarting are finished during a period from t1 to t3. This is because it is not necessary to add margins as time (ta in Embodiment 1) for eliminating secondary loops surely different from Embodiment 1. Accordingly, it becomes possible to restart the rotation of each of conveyance motors earlier correspondingly to the shortened time.

Embodiment 5

In one motor, a conveyance speed and time required for acceleration and deceleration are described.

Figure 15:
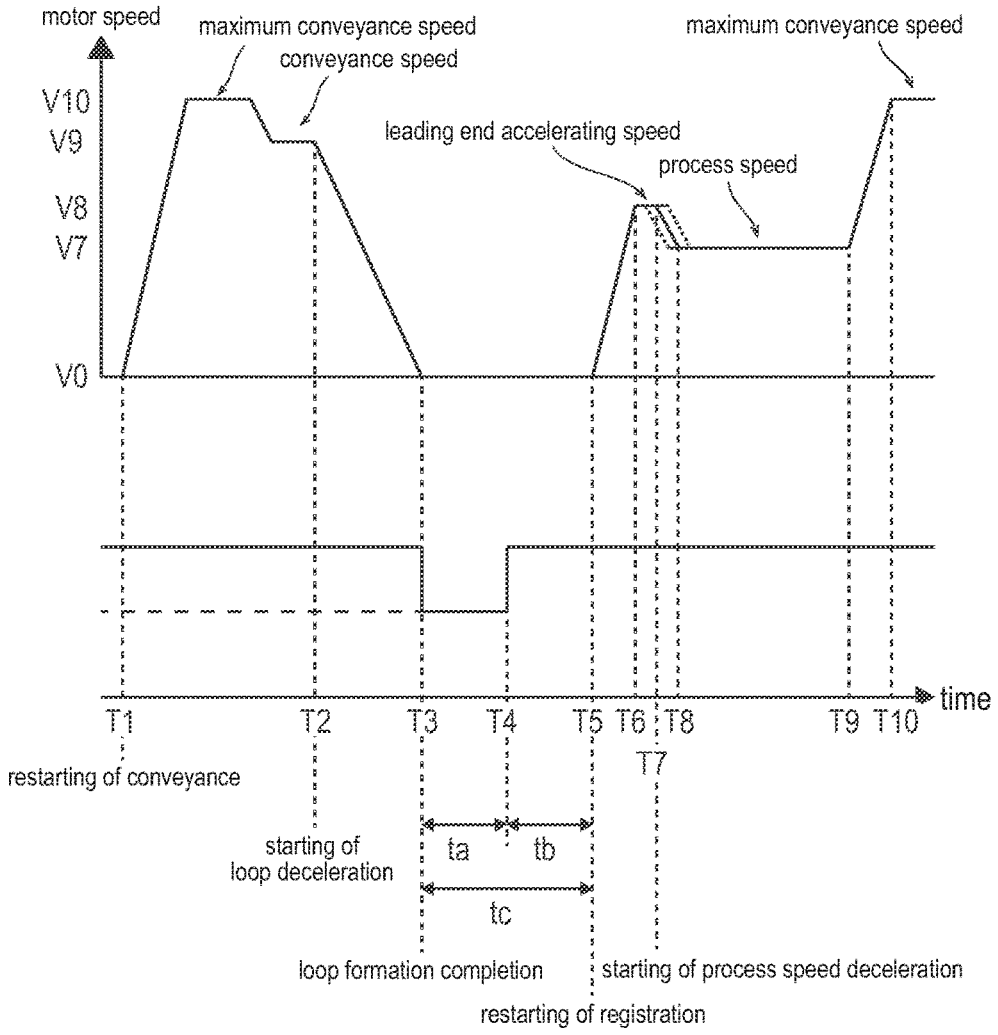
FIG. 15 is a time chart showing a conveyance speed and time required for acceleration and deceleration, stop, and restart in one motor.

FIG. 15 is a time chart showing a conveyance speed and time required for acceleration, deceleration, stop, and restart in one motor. In FIG. 15, the upper stage is a graph of a rotation speed of a motor, and an axis of ordinate shows a rotation speed. The lower stage is a graph showing ON and OFF of an exciting current for a motor. In each of the graphs, an axis of abscissa shows time.

In the operation of one conveyance motor, as shown in FIG. 15, in a stop state (T0, V0, herein, T-numeral represents time, and V-numeral represents speed), when receiving a sheet conveyance instruction (T1: restarting of conveyance), the motor is accelerated to a maximum conveyance speed (V10), and conveys a paper sheet at a conveyance speed (V10 to V9). With regard to the conveyance speed (V10 to V9) during this period, initially, the conveyance speed is the maximum conveyance speed (V10). However, at a position where the paper sheet has advanced to some extent, the paper sheet is conveyed at a decelerated speed (V9) in consideration of stopping the paper sheet by binging the paper sheet in contact with the registration roller pair 26 later. When the leading end of the paper sheet is brought in contact with the registration roller pair 26, deceleration is started in order to form a loop (T2: starting of loop deceleration). During a period from the loop deceleration start (T2) to loop formation completion (T3, V0) at which the decelerated conveyance speed becomes 0, a loop is formed on the paper sheet brought in contact with the registration roller pair 26. Moreover, in this figure, the exciting current for the motor is turned OFF simultaneously with the loop formation completion (T3).

After that, the stopping of the exciting current for the motor is continued for a specified time. The period of time when the excitation is being stopped is an excitation OFF time ta. During the excitation-OFF times ta, the restoring force of the paper sheet is eliminated. Then, an exciting current is made to flow for restarting (T4: called restarting of registration). After the exciting current ON, a state where the rotation has been stopped is continued (tb). This time tb is pre-excitation time tb. After the pre-excitation-time tb has elapsed, the rotation of the motor is restarted (T5: restarting of registration). The conveyance speed is accelerated to a specified speed (V8: leading end accelerating speed) (T6), and thereafter, the conveyance speed is decelerated so as to become process speed (V7) (T7: starting of process speed deceleration). In the operation after the registration restarting, the rotation of each of the registration roller pair 26 and the loop roller pair 25 is also started synchronously. The starting of process speed deceleration (T7) varies depending on the image formation state of the image former. The process speed (V7) is a speed synchronized with the image formation speed by the image formers 10Y, 10M, 10C, and 10K. When the conveyance speed reaches the process speed (V7) (T8), thereafter, the process speed (V7) is maintained until the process (image formation) has been finished. Then, simultaneously with the finishing of the image formation (T9), the conveyance speed is accelerated until the conveyance speed becomes the maximum conveyance speed (V10), and the paper sheet is conveyed at the maximum conveyance speed. After that (after T10), the conveyance speed is maintained until the sheet conveyance has been finished, and then, the print operation for this paper sheet will be finished.

Herein, during the period of time obtained by adding the excitation OFF time ta and the pre-excitation time tb, the loop formed between the registration roller pair 26 and the loop roller pair 25 has been maintained. From this, the time obtained by adding the excitation OFF time ta and the pre-excitation time tb is made loop stopping time tc. The loop stopping time tc is obtained by the following formula (1) from the viewpoint of productivity.

$$tc = \text{tppm} - \alpha - \beta - td - tm \quad (1)$$

In the formula, tppm (print cycle time)=60/(sheet length× coefficient/conveyance speed), provided that the conveyance speed is the conveyance speed of a paper sheet, and is also referred to as a line speed, α=time from the restarting of the registration of the previous paper sheet to the restarting of the conveyance of the paper sheet currently being conveyed, β=time from the restarting of the conveyance to the completing of the loop formation, td=control variation by software+productivity variation, and tm=margin.

Herein, tppm is a value determined based on sheet length and speed as described in the above, and each of td and tm is also a value determined based on the software introduced into the apparatus, or the apparatus constitution. Accordingly, these values cannot be changed.

Herein, from FIG. 15, there is a relationship of $$tc = ta + tb. \quad (2)$$

As has already described, in the case where the motor is a stepping motor, tb is time required until motor vibration at the time of re-excitation ON converges, and is a value peculiar to a motor or apparatus constitution. Accordingly, tb also cannot be changed.

In that case, since ta can be changed, if ta can be shortened, it is possible to shorten tc. That is, the situation is made to ta≤tc−tb.

Figure 16:
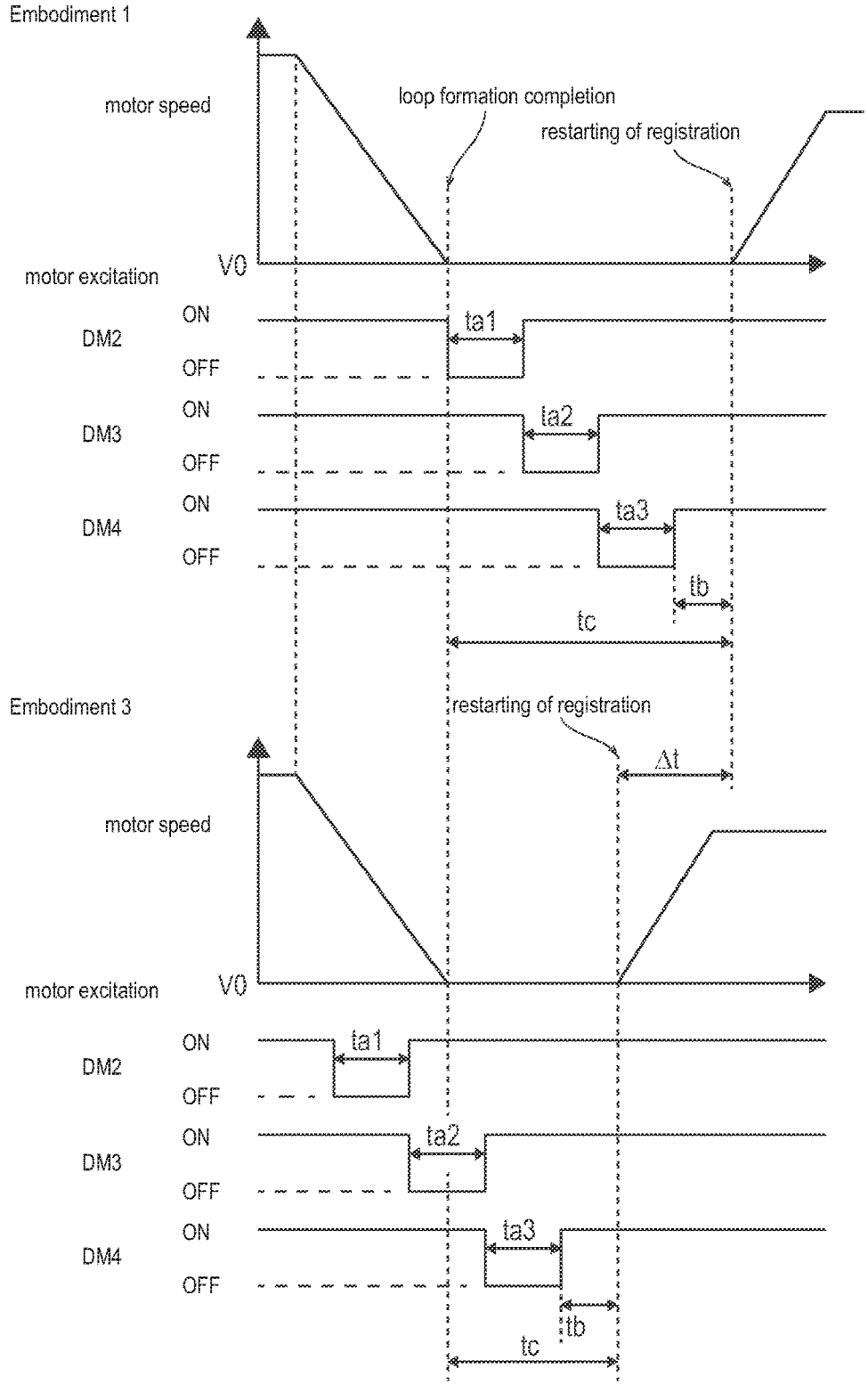
FIG. 16 is a graph for describing a difference in time until the restarting of registration (the restarting of rotation of motors) between Embodiment 1 and Embodiment 3.

The reducing of this ta can be attained by the already described Embodiments 3 and 4. FIG. 16 is a graph for describing a difference in the time until the restarting of the registration (starting of the rotation of motors) between Embodiment 1 and Embodiment 3. Here, the case of three motor DM2 to DM4 on the duplex conveyance pathway 63 is described as an example. That is, it is a case of handling a long sheet existing from the second duplex conveyance roller pair 38 to the seventh duplex conveyance roller pair 43 driven by the motors DM2 to DM4 at a time point when the paper sheet has been brought in contact with the registration roller pair 26.

In the case of Embodiment 1, after the loop formation completion, the exciting currents for the motors are made to be cut off sequentially in an order. For this reason, ta is added for each of the motors and, finally, tb is added. Therefore, tc making the loop formation completion as a starting point becomes such that tc=ta1+ta2+ta3+tb.

On the other hand, in Embodiment 3, after the speed deceleration has been started, the exciting current is cut off sequentially in the order from the motor on the upstream side. Accordingly, tc making the loop formation as a starting point completion becomes such that tc=ta3+tb. For this reason, the time required until the restarting of the registration becomes shorter by Δt in Embodiment 3 than Embodiment 1.

In this way, by reducing ta, the time required until the conveyance of the paper sheet is restarted, can be shortened.

In the present Embodiment 5, not only by shortening ta, but also by increasing the leading end accelerating speed or by delaying the process speed deceleration start, the time until the starting of process can be shortened more. By increasing the leading end accelerating speed, the speed of the leading end of the paper sheet to arrive at the image former becomes faster. By delaying the process speed deceleration start, a section (time) in which the paper sheet is conveyed at a faster speed, becomes longer, and the leading end of the paper sheet arrives at the image former quickly corresponding to the longer portion.

Figure 17:
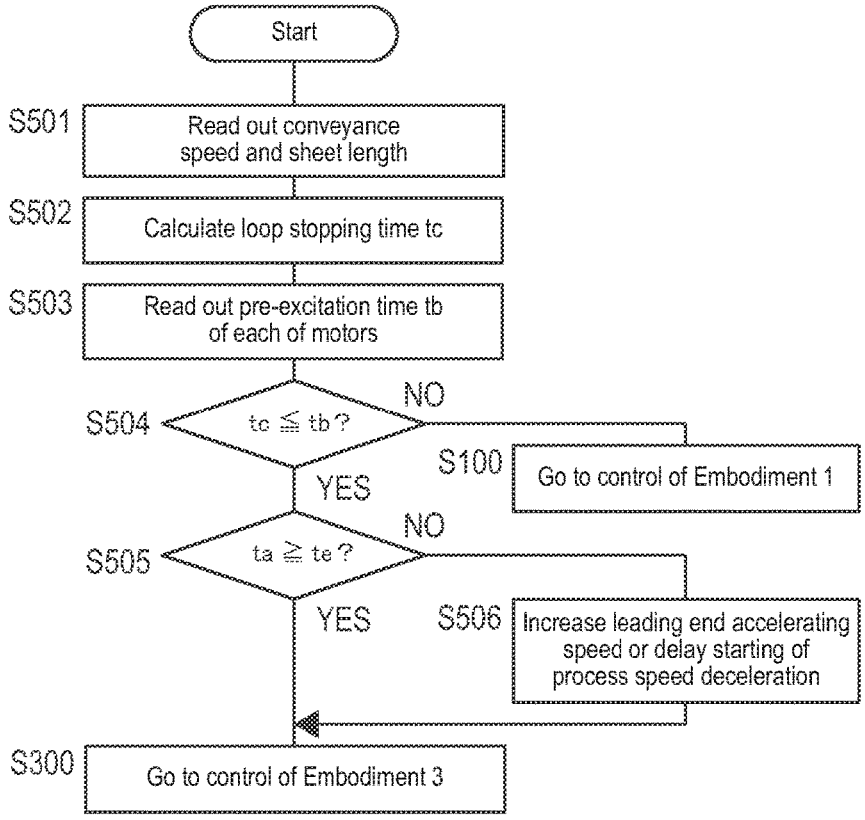
FIG. 17 is a flow chart showing processing procedures in Embodiment 5.

FIG. 17 is a flowchart showing the processing procedures in Embodiment 5. The processing procedures are performed by the processor 90.

In the control procedures in the present Embodiment 5, first, the processor 90 reads out a conveyance speed and a sheet length (S501). The conveyance speed is memorized in a memory in the processor 90 beforehand. When the paper sheets P are set in a sheet feeder 290, the sheet length is recognized automatically, or is input by a user, and is memorized in the memory.

Successively, the processor 90 calculates the loop stopping time tc (S502). The calculation of the loop stopping time tc is performed based on the above-described formula (1).

Successively, the processor 90 reads out the pre-excitation time tb of each of the motors (S503). The pre-excitation time tb is memorized for each of the motors in the memory in the processor 90 beforehand.

Then, the processor 90 compares the calculated tc with the read-out tb (S504). Here, in the case where the comparison result is not tc≤tb (S504: NO), the control of Embodiment 1 is executed (S100).

On the other hand, in the case where the comparison result is tc≤tb (S504: YES), then, the processor 90 compares the time ta with the time te from the starting of the loop speed deceleration to the stopping (S505). The value of ta is calculated based on the above-described formula (2). Here, in the case where the comparison result is not ta≥te (S505: NO), the leading end accelerating speed is increased or the starting of the process speed deceleration is delayed (S506). After that, the control in Embodiment 3 is executed (S300).

On the other hand, in the case where the comparison result is ta≥te (S505: YES), without any change, the control in Embodiment 3 is executed (S300).

As described in the above, according to the present Embodiment 5, for the productivity that varies depending on the conveyance speed and the sheet length, it is decided to control the timing of cutting off the exciting current for motors (so as to be Embodiment 1 or Embodiment 3) and to change the conveyance speed after the restarting. With this, it becomes possible to perform processing suitable for the length of the paper sheet, and in the restarting after the loop formation, it becomes possible to convey the leading end of a paper sheet to the image former at a suitable speed as quickly as possible.

Although the embodiments of the present invention have been described in the above, the present invention should not be limited to these embodiments. For example, a thick paper sheet has been made a target in the embodiments. However, without being limited to this, regardless of thickness, for all kinds of paper sheets, exciting currents for motors to drive a plurality of conveyance roller pairs may be cut off at respective different timings. Moreover, when there are three or more motors, only any one of them may be provided with a different timing (accordingly, the other two are provided with the same timing). By cutting off an exciting current for one of motors at a different timing, the restoring forces on the whole paper sheet are not released simultaneously. Accordingly, it becomes possible to prevent the displacement of the paper sheet from occurring due to the cutting-off of the exciting current.

In addition, in the present invention, based on the constitution described in claims, various modifications can be made. Such modifications are included in the scope of the present invention.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus, comprising:

a registration roller pair;

a loop roller pair that is disposed on an upstream side of the registration roller pair and further pushes a paper sheet brought in contact with the registration roller pair having stopped so as to form a loop on the paper sheet;

a plurality of conveyance roller pairs that are disposed on an upstream side of the loop roller pair;

a plurality of motors that are provided for the plurality of conveyance roller pairs so as to rotate the plurality of conveyance roller pairs; and a processor that controls exciting currents to be supplied to the plurality of motors, wherein after a leading end of the paper sheet is brought in contact with the registration roller pair, the processor controls to cut off the exciting currents supplied to the plurality of motors, and when cutting off the exciting currents, among the plurality of motors driving the plurality of conveyance roller pairs that are conveying the paper sheet, the processor cuts off the exciting current for at least one of the plurality of motors at a different timing from another motor of the plurality of motors.

2. The image forming apparatus according to claim 1, wherein when cutting off the exciting currents, the processor cuts off the exciting currents in an order from the exciting current for the motor to drive the conveyance roller pair located on an upstream side to the exciting current for the motor to drive the conveyance roller pair located on an downstream side among the plurality of conveyance roller pairs being conveying the paper sheet.

3. The image forming apparatus according to claim 1, wherein the processor selects an order of the motors for which the exciting currents are cut off, in accordance with a thickness and stiffness of a paper sheet.

4. The image forming apparatus according to claim 1, wherein the processor cuts off the exciting current for at least one of the motors during a period when a rotation speed of each of the motors is decelerated after the paper sheet has been brought in contact with the registration roller pair.

5. The image forming apparatus according to claim 1, wherein the processor detects counter electromotive force in at least one of the motors, and based on a detection result, the processor cuts off the exciting current for at least the other one of the plurality of motors.

6. The image forming apparatus according to claim 1, wherein based on a conveyance speed and sheet length of the paper sheet, the processor control a timing at which the exciting currents for the motors are cut off and a conveyance speed after the motors have been restarted again after the exciting currents have been cut off.

7. The image forming apparatus according to claim 1, wherein at least one of the conveyance roller pairs is disposed on a crooked conveyance pathway.

8. The image forming apparatus according to claim 1, wherein the loop roller pair includes at least two roller pairs driven independently, which are disposed in a direction intersecting with a conveyance direction of the paper sheet.

* * * * *